US005155016A

United States Patent [19]

Mizukawa et al.

[11] Patent Number: 5,155,016

[45] Date of Patent: Oct. 13, 1992

[54] SILVER HALIDE COLOR PHOTOGRAPHIC MATERIAL CONTAINING NOVEL PYRAZOLOAZOLE COUPLER AND METHOD TO PRODUCE COLOR IMAGE

[75] Inventors: Yuki Mizukawa; Tadahisa Sato, both of Kanagawa, Japan

[73] Assignee: Fuji Photo Film Co., Ltd., Kanagawa, Japan

[21] Appl. No.: 580,874

[22] Filed: Sep. 11, 1990

Related U.S. Application Data

[63] Continuation-in-part of Ser. No. 384,757, Jul. 25, 1989, abandoned.

[30] Foreign Application Priority Data

Jul. 27, 1988 [JP] Japan ..... 63-187340

[51] Int. Cl.[5] ..... G03C 7/38

[52] U.S. Cl. ..... 430/558; 430/543

[58] Field of Search ..... 430/558, 226, 955, 958, 430/543

[56] References Cited

U.S. PATENT DOCUMENTS

| | | | |
|---|---|---|---|
| 3,770,447 | 11/1973 | Bole et al. | 430/558 |
| 4,298,962 | 2/1981 | Lau | 430/382 |
| 4,351,897 | 9/1982 | Aoki et al. | 430/555 |
| 4,500,630 | 2/1985 | Sato et al. | 430/386 |
| 4,540,654 | 9/1985 | Sato et al. | 430/381 |
| 4,621,046 | 11/1986 | Sato et al. | 430/381 |
| 4,801,520 | 1/1989 | Inoue et al. | 430/378 |
| 4,840,878 | 6/1989 | Hirose et al. | 430/380 |
| 4,842,985 | 6/1989 | Ono et al. | 430/226 |
| 4,853,319 | 9/1989 | Krishnamurthy et al. | 430/387 |
| 4,857,449 | 8/1989 | Ogawa et al. | 430/546 |

FOREIGN PATENT DOCUMENTS

| | | |
|---|---|---|
| 59-162548 | 9/1984 | Japan . |
| 59-171956 | 9/1984 | Japan . |
| 60-033552 | 2/1986 | Japan . |
| 62-186262 | 8/1987 | Japan . |
| 62-209457 | 9/1987 | Japan . |
| 63-041851 | 2/1988 | Japan . |
| WO8804795 | 6/1988 | PCT Int'l Appl. . |
| 1047612 | 11/1966 | United Kingdom . |

*Primary Examiner*—Lee C. Wright

*Attorney, Agent, or Firm*—Birch, Stewart, Kolasch & Birch

[57] ABSTRACT

A silver halide photographic material comprising a support having thereon at least one silver halide emulsion layer and at least one coupler represented by the following general formula (I):

(I)

wherein (Q) represents a pyrazoloazole type color image forming coupler residue; $L_1$ and $L_2$ each represents a methylene group or an ethylene group; l and m each represents 0 or 1; $R_1$ represents a hydrogen atom, an alkyl group, an aryl group or a heterocyclic group; $R_2$ represents a group connecting with A through a carbon atom, an oxygen atom, a nitrogen atom or a sulfur atom; A represents a carbon atom or a sulfur atom; n represents 1, when A is a carbon atom, or 1 or 2, when A is a sulfur atom; B represents a carbon atom, an oxygen atom, a nitrogen atom or a sulfur atom; X represents an atomic group necessary to form a ring; $R_1$ and $R_2$ may connect with each other to form a ring; and B and $R_2$ may connect with each other to form a ring, when B is a carbon atom or a nitrogen atom.

A method of forming a color image comprising developing a silver halide photographic material with a developing solution containing an aromatic primary amine in the presence of a at least one coupler represented by the general formula (I) described above is also disclosed.

The coupler represented by the general formula (I) has good color reproducibility due to being free from the undesirable subsidiary absorption of the dye formed therefrom and a high color forming rate, and provides a sufficiently high color density even when an amount of silver employed in the light-sensitive material is reduced or the light-sensitive material is subjected to a rapid processing method and a low level of fog. Further, the dye formed from the coupler exhibits excellent fastness.

32 Claims, No Drawings

SILVER HALIDE COLOR PHOTOGRAPHIC MATERIAL CONTAINING NOVEL PYRAZOLOAZOLE COUPLER AND METHOD TO PRODUCE COLOR IMAGE

This application is a continuation-in-part of application Ser. No. 07/384,757 filed on Jul. 25, 1989, now abandoned.

FIELD OF THE INVENTION

The present invention relates to a silver halide photographic material and a method of forming a color image, and particularly to a method of forming a color image using a silver halide color photographic material which has good color reproducibility and a high color forming rate and provides a high color density even when it is subjected to rapid processing. More specifically, it relates to a method of forming a color image which comprises developing a silver halide color photographic material containing a magenta coupler having a releasing group which is connected to the dye forming position though a sulfur atom with a developing solution containing an aromatic primary amine.

BACKGROUND OF THE INVENTION

It is known that an aromatic primary amine color developing agent oxidized with exposed silver halide as an oxidizing agent reacts with a coupler to form a dye such as an indophenol, an indoaniline, an indamine, an azomethine, a phenoxazine, a phenazine and the like, thus forming a color image. In order to form a magenta color image, a 5-pyrazolone type coupler, a cyanoacetophenone type coupler, an indazolone type coupler, a pyrazolobenzimidazole type coupler or a pyrazolotriazole type coupler is employed.

Magenta color image forming couplers which have been widely used in practice and on which various investigations have been made are almost all 5-pyrazolones. However, it is known that dyes formed from 5-pyrazolone type couplers have an undesirable absorption of yellow component in the region around 430 nm, which causes color turbidity.

In order to reduce yellow component absorption, a pyrazolobenzimidazole nucleus as described in British Patent 1,047,612, an indazolone nucleus as described in U.S. Pat. No. 3,770,447 and a 1H-pyrazolo[5,1-c]-1,2,4-triazole nucleus as described in U.S. Pat. No. 3,725,067 have been proposed as a magenta color image forming coupler skeleton. Further, an imidazopyrazole nucleus as described in JP-A-59-162548 (the term "JP-A" as used herein means an "unexamined published Japanese patent application"), a 1H-pyrazolo[1,5-b]-1,2,4-triazole nucleus as described in JP-A-59-171956 and a pyrazolotetrazole nucleus as described in JP-A-60 33552 have been recently proposed as novel magenta color image forming coupler skeletons.

On the other hand, in order to save on the amount of silver used in color light-sensitive materials, while responding to the need for rapid processing and improved preservability of color light-sensitive materials, so-called two-equivalent couplers having a releasing group at the dye forming position of the coupler skeleton have been investigated.

5-pyrazolone type couplers having a releasing group connected to the dye forming position through a sulfur atom are known and described in many patents. However, many of these couplers have difficulties in that they have low color forming properties. For instance, they are apt to cause the formation of fog, they cause silver halide to degrade photographic properties, they adversely affect fastness of color images, and they are unstable per se. For such reasons they have not been employed in practice.

The couplers as described in U.S. Pat. No. 4,351,897 are superior in view of overcoming these disadvantages. However the problem of color turbidity is still present in these couplers. Further, they have a problem in that density color image is reversed particularly at the high density portion (Dm inversion). In order to solve these problems, it is necessary to employ a fine grain emulsion, etc.

Recently, the couplers described in WO 88/04795 have been disclosed. They have a good color forming property particularly in rapid processing and the inversion at the high density portion is restrained without using a fine grain emulsion. However, the problem of color turbidity is still not solved with these couplers. Further, they tend to form color in unexposed portions, resulting in the formation of so-called fog.

Among pyrazoloazole type couplers with which the problem of color turbidity is prevented, those having a releasing group connected to the dye forming position through a sulfur atom are described, for example, in JP-A-62-186262, JP-A-62-209457 and JP-A-63-41851. These couplers exhibit improved color forming properties and fastness of color image formed therefrom, but the same are still insufficient. In particular, the color forming property is inferior in case of rapid processing and sufficiently high color density can not be obtained. Moreover, it has been desired that couplers formed therefrom exhibit more improved fastness of color image.

As described above, it has been desired to provide couplers having good color reproducibility (due to the same being free from the undesirable subsidiary absorption of the dye formed therefrom). Also, it has been desired to provide couplers having a high color forming rate and which can provide a sufficiently high color density even under condition where the amount of silver employed in the light sensitive material is reduced or the light-sensitive material is subjected to rapid processing. Further, it has been desired to provide the same while producing a low level of fog. Furthermore, a silver halide color photographic material containing a coupler capable of forming color image having improved fastness has been desired.

SUMMARY OF THE INVENTION

Therefore, an object of the present invention is to provide a silver halide photographic material containing a coupler which fulfills the requirements described above.

Another object of the present invention is to provide a method of forming a color image using a coupler which fulfills the requirements described above.

Other objects of the present invention will become apparent from the following description and examples.

These objects of the present invention can be accomplished by a method of forming a color image, which comprises developing a silver halide photographic material with a developing solution containing an aromatic primary amine in the presence of at least one coupler represented by the following general formula (I):

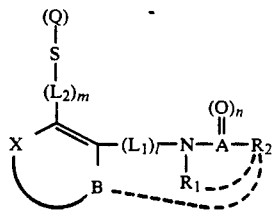

(I)

wherein (Q) represents a pyrazoloazole type color image forming coupler residue; $L_1$ and $L_2$ each represents a methylene group or an ethylene group; l and m each represents 0 or 1; $R_1$ represents a hydrogen atom, an alkyl group, an aryl group or a heterocyclic group; $R_2$ represents a group connecting with A through a carbon atom, an oxygen atom, a nitrogen atom or a sulfur atom; A represents a carbon atom or a sulfur atom; n represents 1, when A is a carbon atom, or 1 or 2, when A is a sulfur atom; B represents a carbon atom, an oxygen atom, a nitrogen atom or a sulfur atom; X represents an atomic group necessary to form a ring; $R_1$ and $R_2$ may connect with each other to form a ring; and B and $R_2$ may connect with each other to form a ring, when B is a carbon atom or a nitrogen atom.

DETAILED DESCRIPTION OF THE INVENTION

Now, the coupler represented by the general formula (I) will be explained in detail below.

The pyrazoloazole type color image forming coupler residue represented by (Q) in the general formula (I) is preferably a residue represented by the following general formula (II):

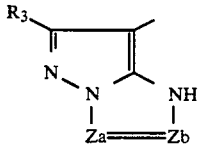

(II)

wherein $R_3$ represents a hydrogen atom or a substituent; Za and Zb each represents —CH=,

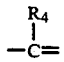

or —N=; and $R_4$ represents a hydrogen atom or a substituent.

The substituent represented by $R_3$ or $R_4$ includes a straight chain, branched chain or cyclic, substituted or unsubstituted alkyl group having from 1 to 30 carbon atoms (for example, methyl, ethyl, isopropyl, tertbutyl, cyclohexyl, or adamantyl), an aryl group (for example, phenyl, p-tolyl, 2-methoxyphenyl, 2-pivaloylamidophenyl, 2-chlorophenyl, 2,4-dimethoxyphenyl, or naphthyl), a heterocyclic group (for example, 4-pyridyl, or 2-furyl), an alkoxy group (for example, methoxy, ethoxy, isopropyloxy, 2-phenoxyethoxy, or 2-methoxyethoxy), an aryloxy group (for example, phenoxy, 2-methoxyphenoxy, 2-chlorophenoxy, 2,4-dimethoxyphenoxy, 3-butanesulfonamidophenoxy, 2,5-di-tert-amylphenoxy, or 2-naphthoxy), a heterocyclic oxy group (for example, 2-furyloxy), an amino group (for example, N-methylamino, or N,N-dibutylamino), an anilino group (for example, 2-methoxyanilino, 2-chloroanilino, 2,4-dichloroanilino, or N-methylanilino), a heterocyclic amino group (for example, 4-pyridylamino), an amido group (for example, acetamido, or benzamido), a urethane group (for example, N-hexylurethane, or N,N-dibutylurethane), a ureido group (for example, N,N-dimethylureido, or N-phenylureido), a sulfonamido group (for example, butanesulfonamido, or p-toluenesulfonamido), an alkylthio group (for example, ethylthio, or octylthio), an arylthio group (for example, phenylthio, or 4-dodecylphenylthio), a sulfinyl group (for example, benzenesulfinyl), a sulfonyl group (for example, methanesulfonyl, octanesulfonyl, or p-toluenesulfonyl), a sulfo group, a cyano group and a nitro group.

Of the compounds represented by the general formula (II), those represented by the general formula (III) or (IV) described below are preferred.

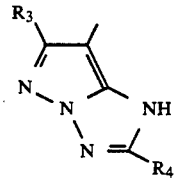

(III)

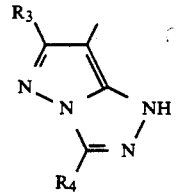

(IV)

wherein $R_3$ and $R_4$ each has the same meaning as defined in the general formula (II).

Further, of the compounds represented by the general formula (III) or (IV), those wherein $R_3$ and $R_4$ each represents an alkyl group, an aryl group, an alkoxy group or an aryloxy group are particularly preferred. Among them, the compounds represented by the general formula (III) wherein $R_3$ represents an alkoxy group or an aryloxy group provide a high color forming density.

Now, the releasing group portion of the compound represented by the general formula (I) will be explained in detail below.

$L_1$ and $L_2$ in the general formula (I) each represents a substituted or unsubstituted methylene or ethylene group. Suitable examples of the substituents include a halogen atom (for example, fluorine, chlorine, or bromine), an aliphatic group (for example, a straight chain or branched chain alkyl group having from 1 to 22 carbon atoms, an aralkyl group, an alkenyl group, an alkynyl group, a cycloalkyl group, or a cycloalkenyl group), an aryl group (for example, phenyl, or naphthyl), a heterocyclic group (for example, 2-furyl, or 3-pyridyl), an alkoxy group (for example, methoxy, ethoxy, or cyclohexyloxy), an aryloxy group (for example, phenoxy, p-methoxyphenoxy, or p-methylphenoxy), an alkylamino group (for example, ethylamino, or dimethylamino), an alkoxycarbonyl group (for example, methoxycarbonyl, or ethoxycarbonyl), a carbamoyl group (for example, N,N-dimethylcarbamoyl), an anilino group (for example, phenylamino, or N ethylanilino), a sulfamoyl group (for example, N,N-diethylsulfamoyl), an alkylsulfonyl group (for example, methylsulfonyl), an arylsulfonyl group (for example, tolylsulfonyl), an alkylthio group (for example, methylthio, or octylthio group), an arylthio group (for example, phenylthio, or 1 naphthylthio), an acyl group (for example, acetyl, or benzoyl), an acylamino group (for example, acetamido, or benzamido), an imido group (for example, succinimido, or phthalimido), a ureido group (for example, phenylureido, or N,N-dibutylureido), a sulfamoylamino group (for example, N,N-dipropylsulfamoylamino), an alkoxycarbonylamino group (for example, methoxycarbonylamino), a sulfonamido group (for example, methanesulfonamido), a hydroxy group and a cyano group. $L_1$ and $L_2$ each preferably represents an unsubstituted methylene or ethylene group.

l and m each represents 0 or 1, preferably 0.

$R_1$ represents a hydrogen atom, an alkyl group, an aryl group or a heterocyclic group. More specifically, $R_1$ represents a hydrogen atom, an alkyl group, for example, a straight chain or branched chain alkyl group having from 1 to 22 carbon atoms, an alkenyl group, or cycloalkyl group, an aryl group, for example, phenyl, or naphthyl, or a heterocyclic group, for example, 2-furyl, 2-thienyl, 2-pyrimidinyl, or 4-pyridyl. These groups may further have one ore more substituents selected from those defined for $L_1$ or $L_2$. $R_1$ preferably represents a hydrogen atom or an alkyl group.

More preferably, $R_1$ represents a hydrogen atom, especially when $R_3$ represents an alkyl group or an aryl group.

$R_2$ represents an alkyl group, an aryl group, a heterocyclic group connecting to A through a carbon atom, an acyl group, an alkoxycarbonyl group, a carbamoly group, an alkoxy group, an alkylamino group or an anilino group and the groups each may have one or more substituents selected from those defined for $L_1$ or $L_2$, described above. $R_2$ preferably represents an alkyl group, an aryl group, an alkylamino group, analkoxy group and an anilino group, and more preferably, an alkyl group, an aryl group, an alkylamino group and an anilino group.

n represents 1, when A is a carbon atom, or 1 or 2, when A is a sulfur atom.

B represents a carbon atom, an oxygen atom, a nitrogen atom or a sulfur atom, preferably a carbon atom or a nitrogen atom and more preferably a carbon atom.

X represents an atomic group necessary to form a ring. Preferably, X represents an atomic group composed of atoms selected from a carbon atom, an oxygen atom, a nitrogen atom and a sulfur atom necessary to form a saturated or unsaturated 5-membered, 6-membered or 7-membered ring. More preferably, X represents an atomic group composed of atoms selected from a carbon atom, an oxygen atom and a nitrogen atom necessary to form an unsaturated 5-membered or 6-membered ring. The ring formed with X may further have one or more substituents selected from those defined for $L_1$ or $L_2$ described above, or have another ring condensed thereto.

$R_1$ and $R_2$ may connect with each other to form a ring, preferably a saturated or unsaturated 5-membered or 6-membered ring. The ring further may have one or more substituents selected from those defined for $L_1$ or $L_2$.

When B is a carbon atom or a nitrogen atom, B and $R_2$ may connect with each other to form a ring, preferably a saturated or unsaturated 5-membered or 6-membered ring, and more preferably a saturated 5-membered or 6-membered ring. The ring may further have one or more substituents selected from those defined for $L_1$ and $L_2$ described above.

In accordance with the present invention, the first preferred pyrazoloazole couplers are represented by the following general formula (V):

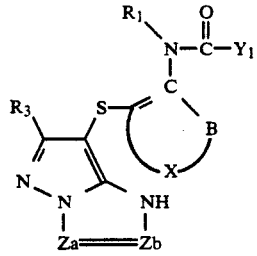

(V)

wherein $Y_1$ represents Ra or $Z_1$—Rb; Ra represents a substituted or unsubstituted aryl group, a substituted or unsubstituted heterocyclic group, or a substituent having a secondary or tertiary group represented by

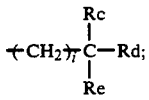

i represents 0 or 1; $Z_1$ represents an oxygen atom, a sulfur atom or NRf; Rb represents a substituted or unsubstituted alkyl group, a substituted or unsubstituted aryl group or a substituted or unsubstituted heterocyclic group; Rc and Rd each represents a halogen atom or a group selected from those defined for Rb and $Z_2$—Rg; Re represents a hydrogen atom or a group selected from those defined for Rc and Rd; Rf represents a hydrogen atom or a group selected from those defined for Rb; $Z_2$ represents an oxygen atom, a sulfur atom or NRh; Rg represents a group selected from those defined for Rf; Rh represents a group selected from those defined for Rf; Rc may connect with at least one of Rd and Re to form one or two carbocyclic rings or tetracyclic rings which may further have one or more substituents; $R_1$, X and B each has the same meaning as defined above; and $R_3$, Za and Zb each has the same meaning as defined in the general formula (II) above.

Of the couplers represented by the general formula (V), more preferred pyrazoloazole couplers are represented by the following general formula (VI):

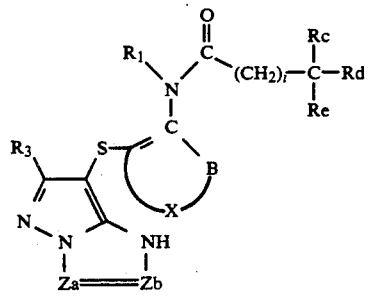

(VI)

wherein $R_3$, Za, Zb, Rc, Rd, Re, X and B each has the same meaning as defined above; and i represents 0 or 1.

The second preferred pyrazoloazole couplers are represented by the following general formula (VII):

(VII)

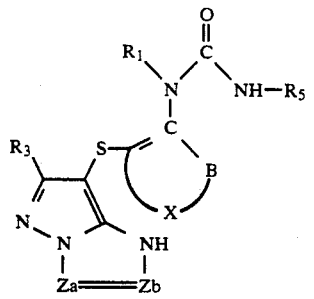

wherein $R_5$ represents a substituted or unsubstituted alkyl group, a substituted or unsubstituted aryl group or a substituted or unsubstituted heterocyclic group; and $R_1$, $R_3$, Za, Zb, X and B each has the same meaning as defined above.

The third preferred pyrazoloazole couplers are represented by the following general formula (VIII):

(VIII)

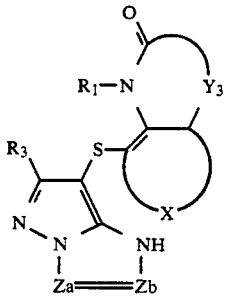

wherein $R_1$, $R_3$, Za, Zb, and X each has the same meaning as defined above; $Y_3$ represents a substituted or unsubstituted methylene or ethylene group or N—Rf; and Rf has the same meaning as defined above.

Of the couplers represented by the general formula (VIII), more preferred pyrazoloazole couplers are represented by the following general formula (IX):

(IX)

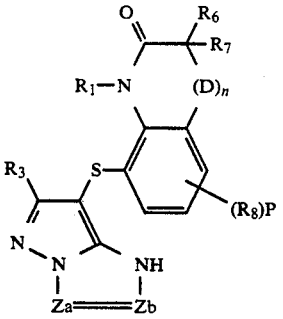

wherein $R_1$, $R_3$, Za and Zb each has the same meaning as defined above; $R_6$ and $R_7$ each represents an alkyl group or an aryl group; $R_8$ represents a substituent selected from those defined for $L_1$ or $L_2$; D represents a methylene group, an oxygen atom, a nitrogen atom or a sulfur atom; n represents an integer from 0 to 3, when D represents a methylene group, or 1, when D represents an oxygen atom, a nitrogen atom or a sulfur atom; and P represents an integer from 0 to 3.

A monomer containing the pyrazoloazole coupler moiety having a releasing group represented by the general formula (I) may form a copolymer together with a non-color forming ethylenic monomer which does not undergo coupling with the oxidation product of an aromatic primary amine developing agent.

Examples of non-color forming ethylenic monomers which do not undergo coupling with the oxidation product of an aromatic primary amine developing agent include an acrylic acid such as acrylic acid, α-chloroacrylic acid, and α-alkylacrylic acid (e.g., methacrylic acid), an ester or an amide derived from an acrylic acid (e.g., acrylamide, n-butylacrylamide, tert-butylacrylamide, diacetoneacrylamide, methacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, or β-hydroxy methacrylate), methylenedibisacrylamide, a vinyl ester (e.g., vinyl acetate, vinyl propionate, or vinyl laurate), acrylonitrile, methacrylonitrile, an aromatic vinyl compound (e.g., styrene and a derivative thereof, vinyltoluene, divinylbenzene, vinylacetophenone, or sulfostyrene), itaconic acid, citraconic acid, crotonic acid, vinylidene chloride, a vinyl alkyl ether (e.g., vinyl ethyl ether), maleic acid, maleic anhydride, a maleic acid ester, N-vinyl-2-pyrrolidone, N-vinylpyridine, or 2- or 4-vinylpyridine.

Two or more kinds of non-color forming ethylenically unsaturated monomers can be used together. For example, a combination of n-butyl acrylate and methyl acrylate, a styrene and methacrylic acid, methacrylic acid and acrylamide, or methyl acrylate and diacetoneacrylamide can be used.

As is well known in the field of polymer color couplers, the non-color forming ethylenically unsaturated monomer which is copolymerized with a solid water-insoluble monomer coupler can be selected in such a manner that the copolymer formed has good physical properties and/or chemical properties, for example, solubility, compatibility with a binder such as gelatin in a photographic colloid composition, flexibility, or heat stability.

The polymer couplers used in the present invention may be water-soluble coupler or water-insoluble couplers, but polymer coupler latexes are particularly preferred as such polymer couplers.

Specific examples of the releasing group (E) in the coupler used in the present invention are set forth below, but the present invention should not be construed as being limited thereto.

E-1)

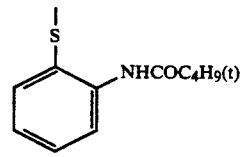

E-2)

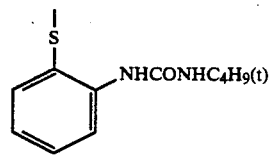

-continued
E-3)
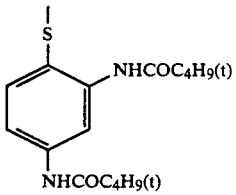
E-4)
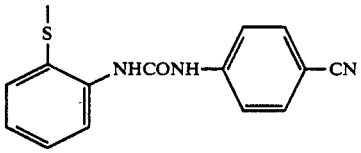
E-5)
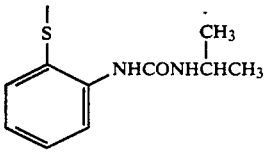
E-6)
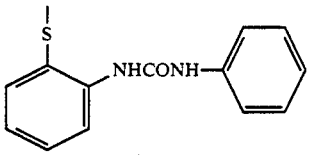
E-7)
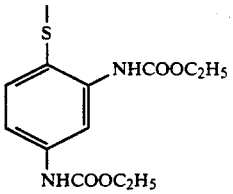
E-9)
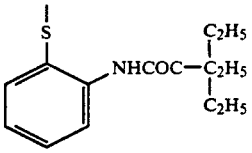
E-10)
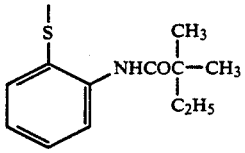
E-11)
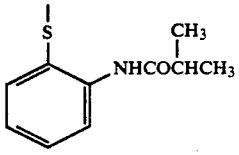
-continued
E-12)
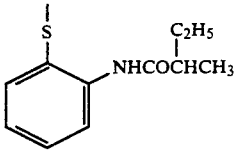
E-13)
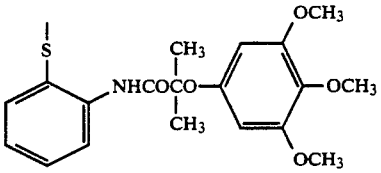
E-14)
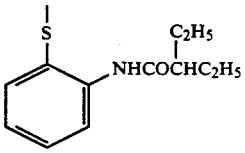
E-15)
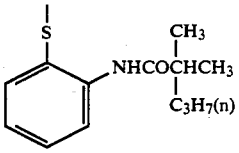
E-16)
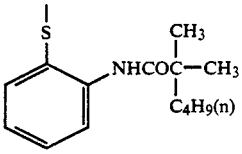
E-17)
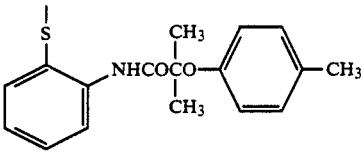
E-18)
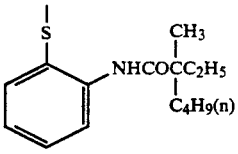
E-19)
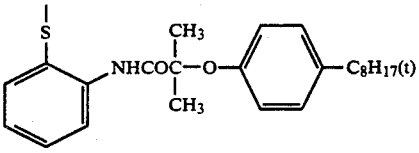
E-20)
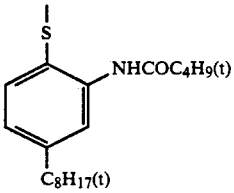

-continued
E-21)
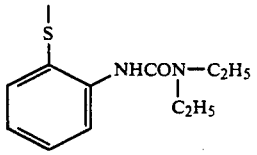
E-22)
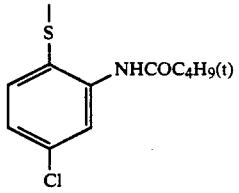
E-23)
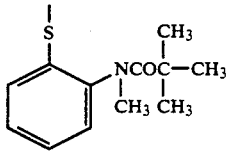
E-24)
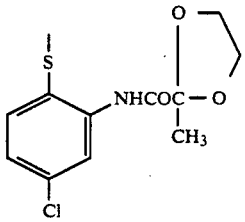
E-25)
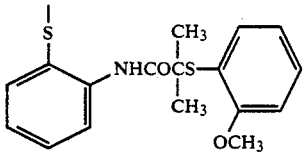
E-26)
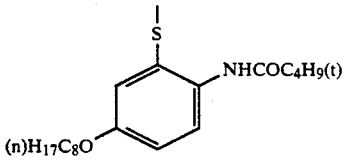
E-27)
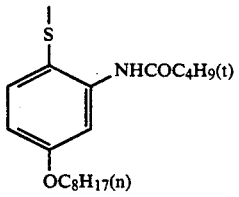
E-28)
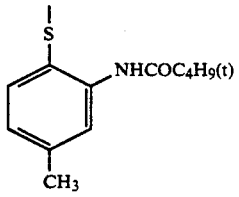
-continued
E-29)
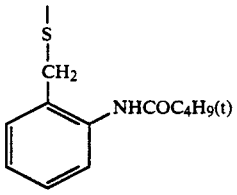
E-30)
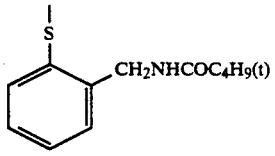
E-31)
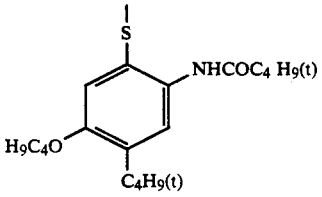
E-32)
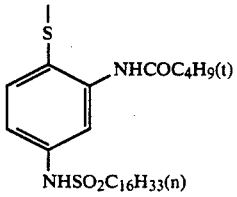
E-33)
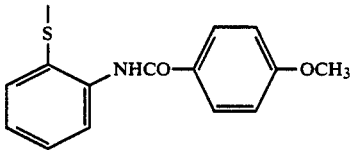
E-34)
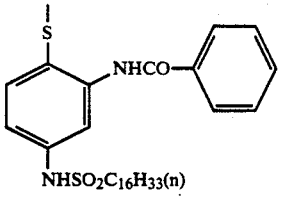
E-35)
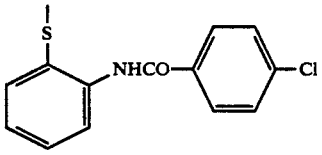
E-36)
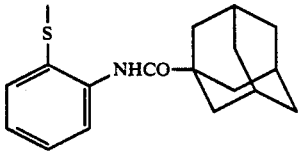

-continued
E-37)
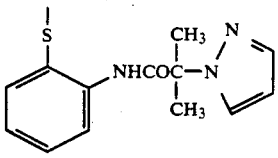
E-38)
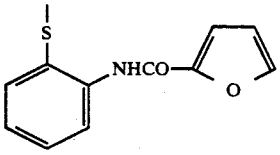
E-39)
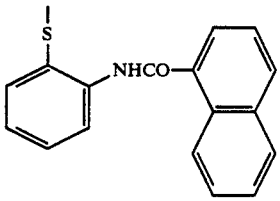
E-40)
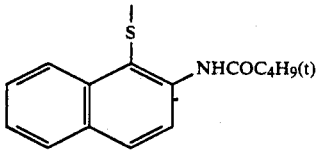
E-41)
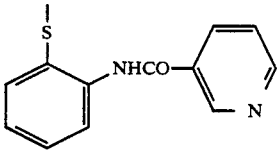
E-42)
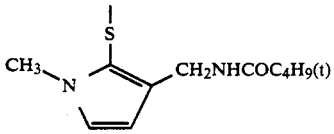
E-43)
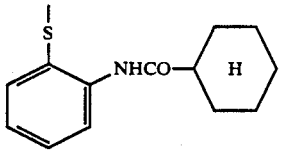
E-44)
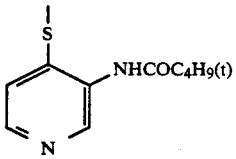
E-45)
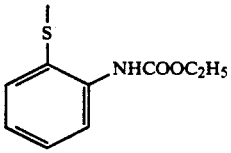
-continued
E-46)
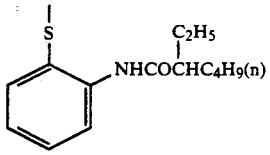
E-47)
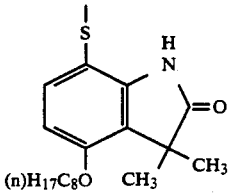
E-48)
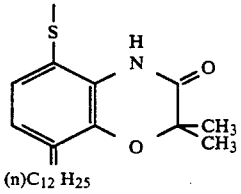
E-49)
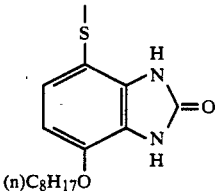
E-50)
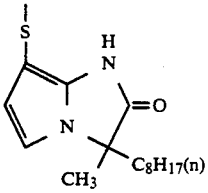
E-51)
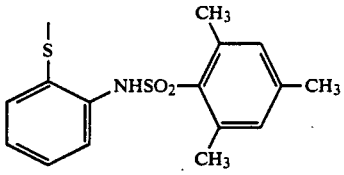
E-52)
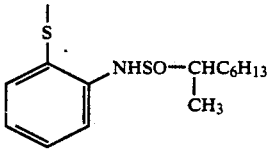
E-53)
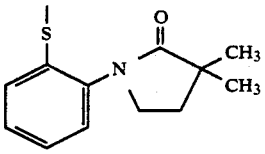

-continued
E-54)
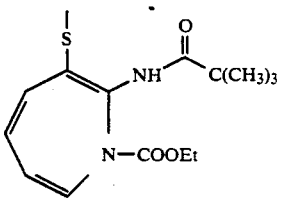
E-55)
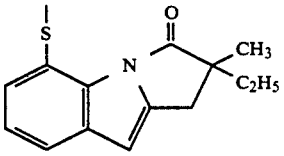
E-56)
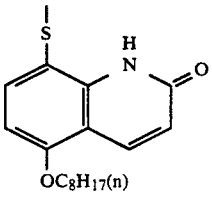
E-57)
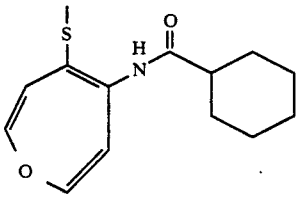
-continued
E-58)
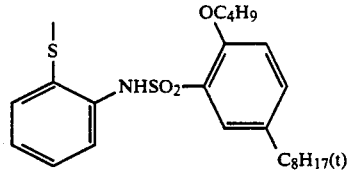
E-59)
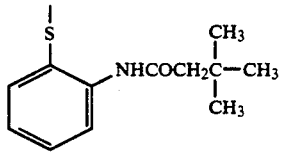
E-60)
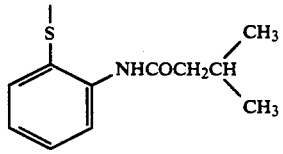
Specific examples of the magenta couplers according to the present invention are set forth below, but the present invention should not be construed as being limited thereto.
M-1
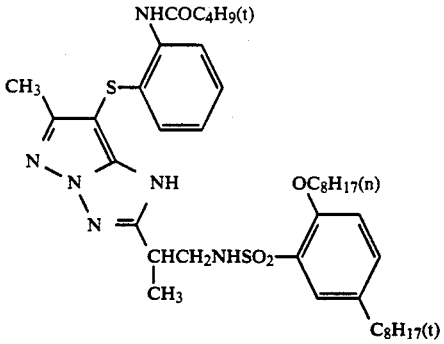
M-2
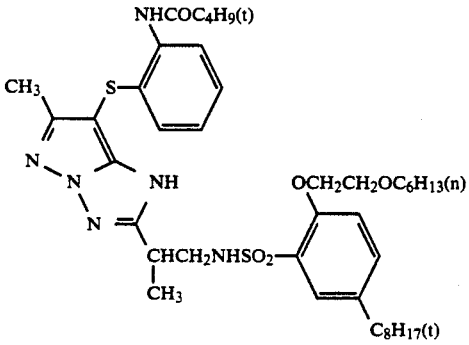

-continued
M-3
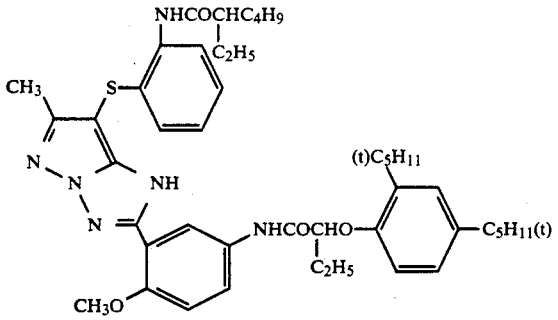
M-4
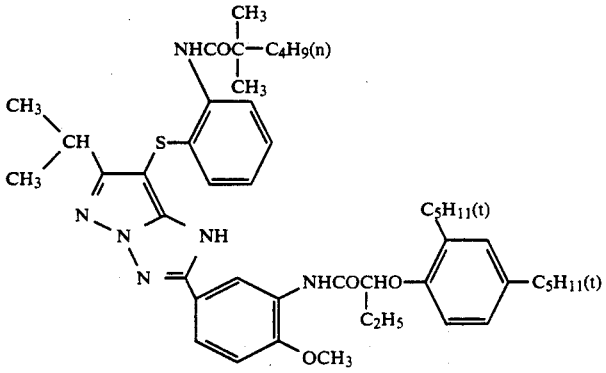
M-5
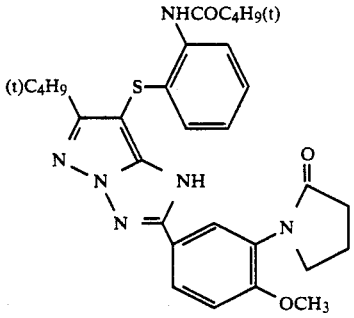
M-6
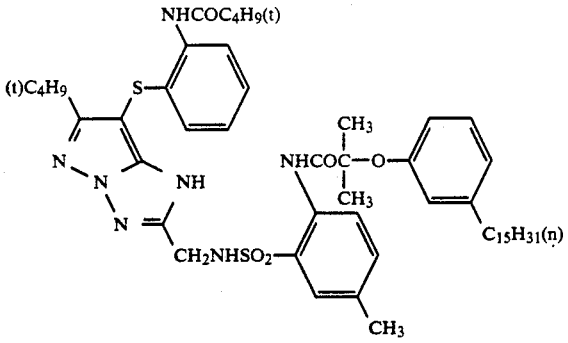
M-7
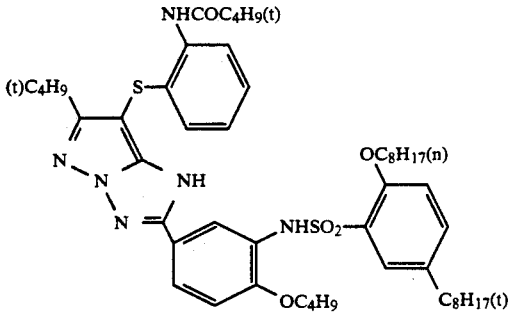

-continued
M-8
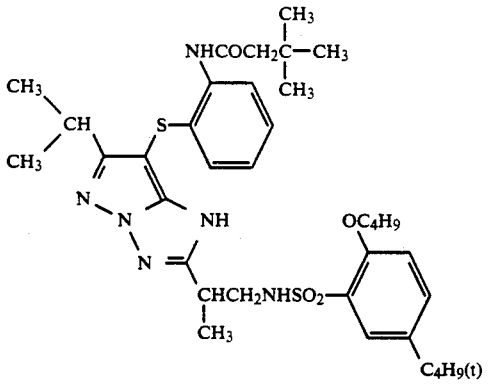
M-9
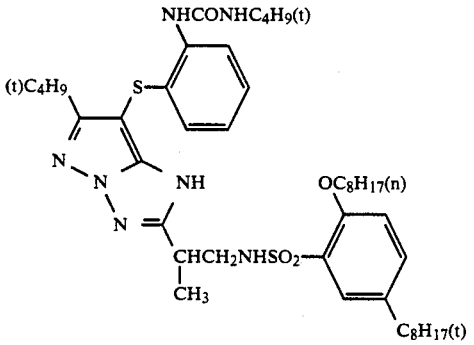
M-10
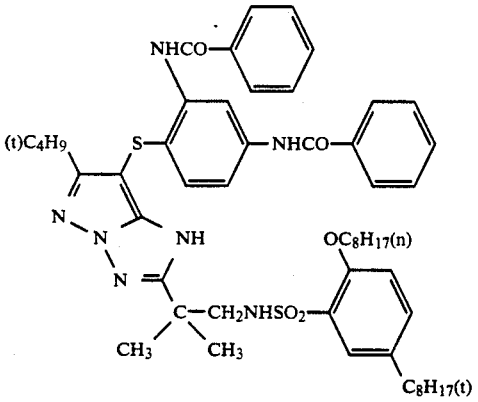
M-11
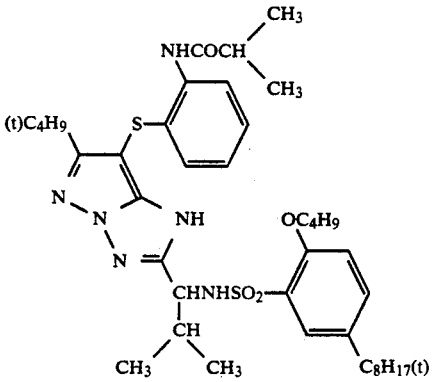

-continued
M-12
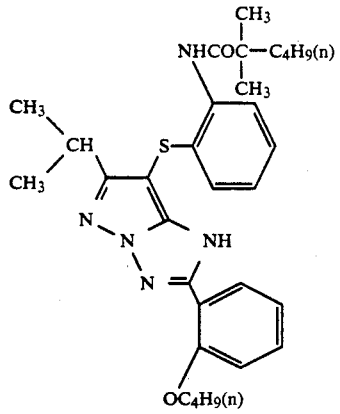
M-13
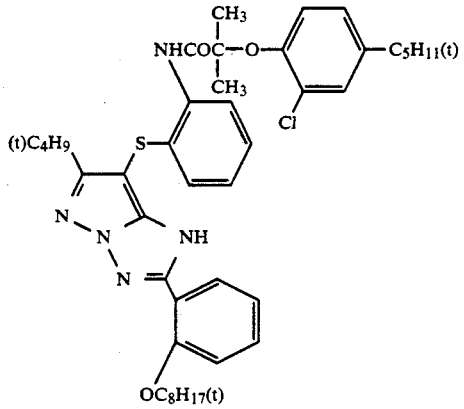
M-14
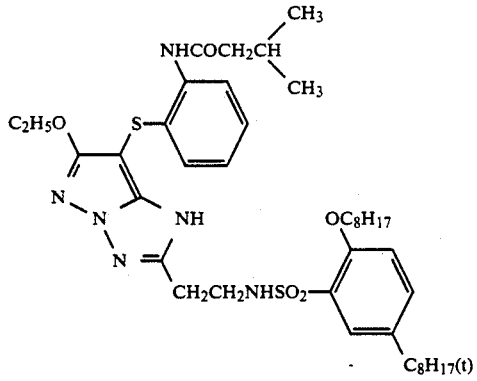
M-15
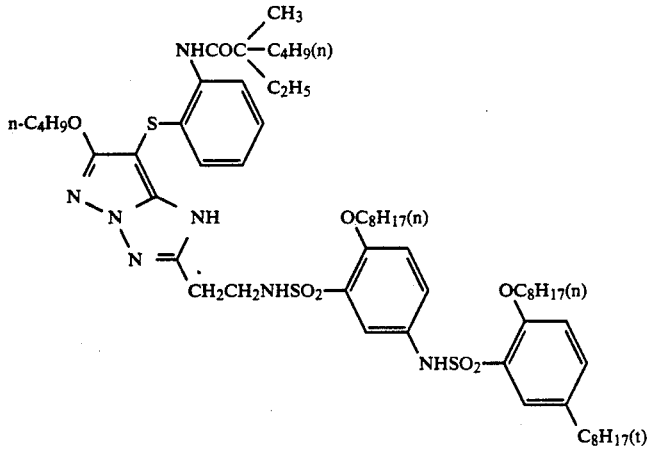

-continued
M-16
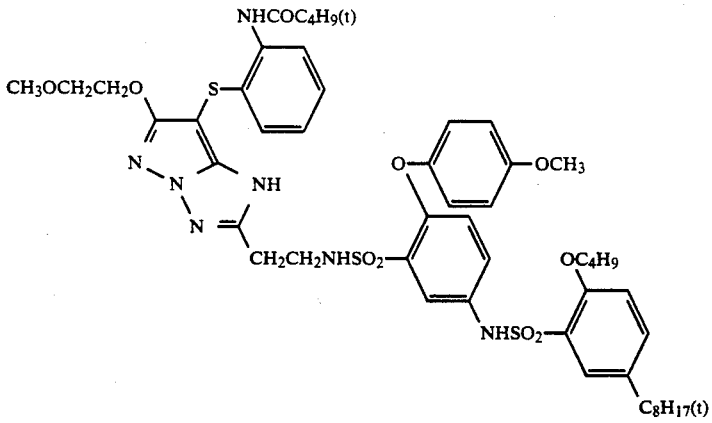
M-17
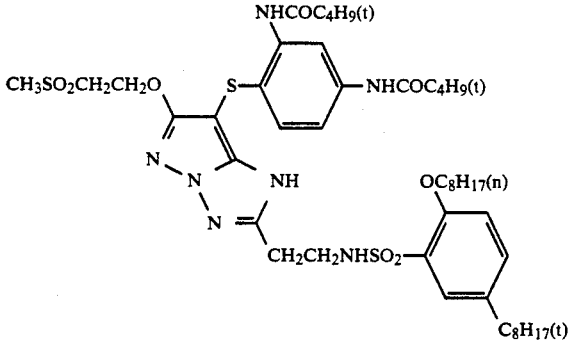
M-18
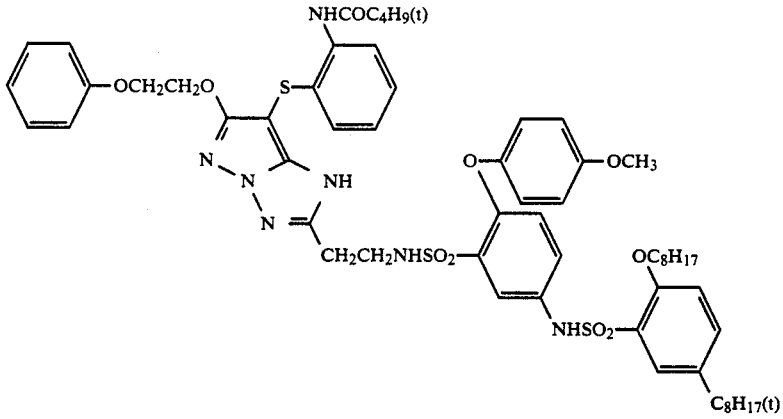
M-19
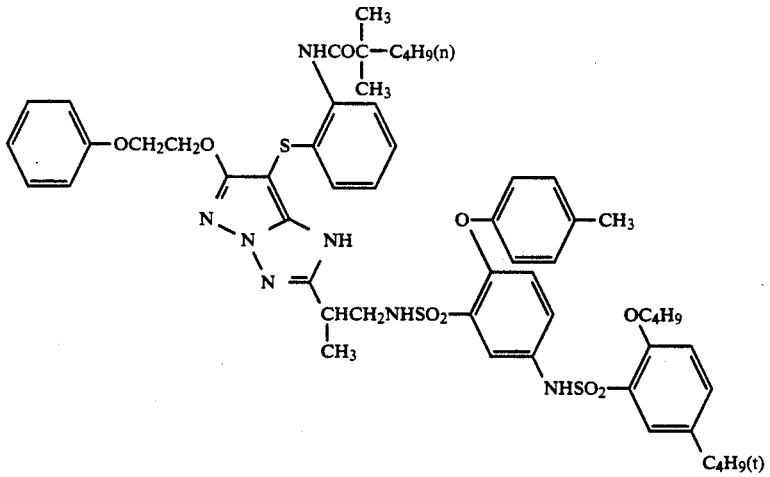

-continued
M-20
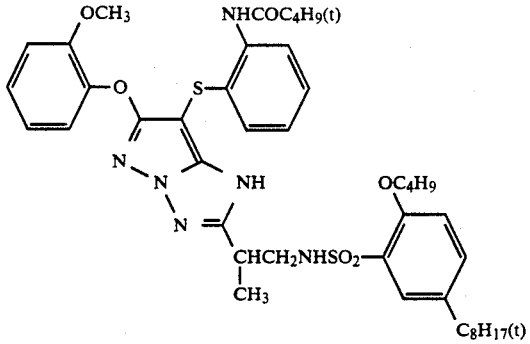
M-21
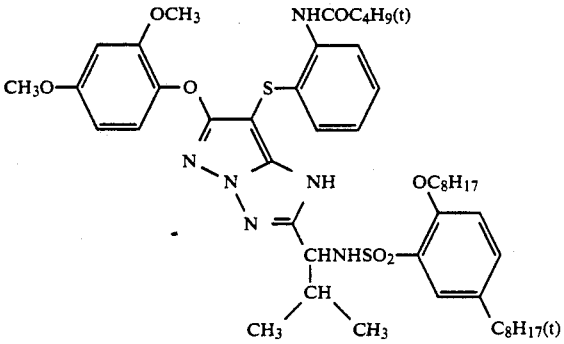
M-22
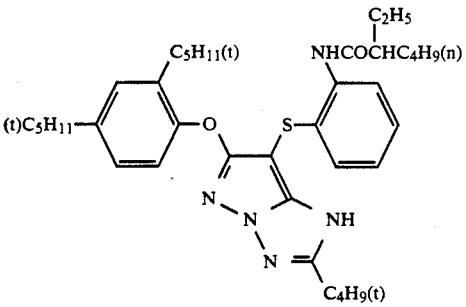
M-23
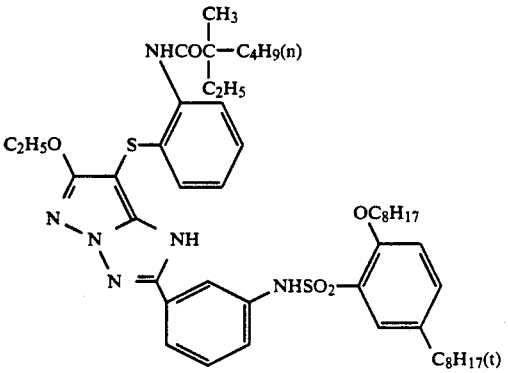

-continued
M-24
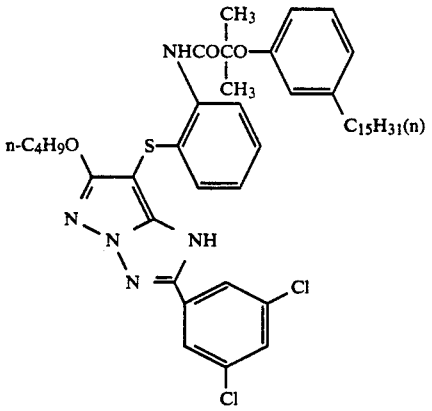
M-25
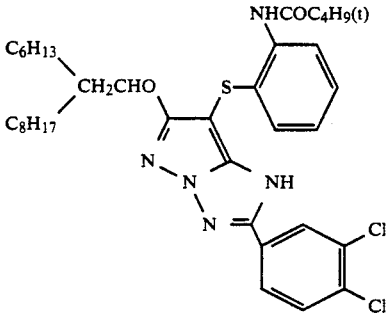
M-26
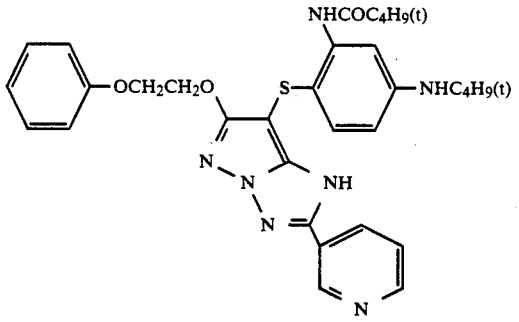
M-27
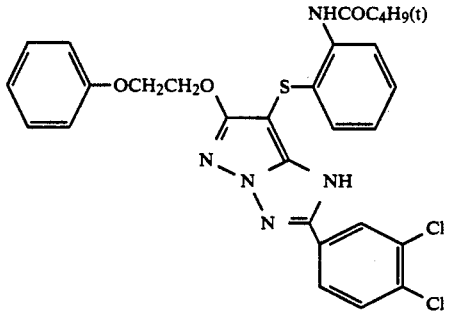

-continued
M-28
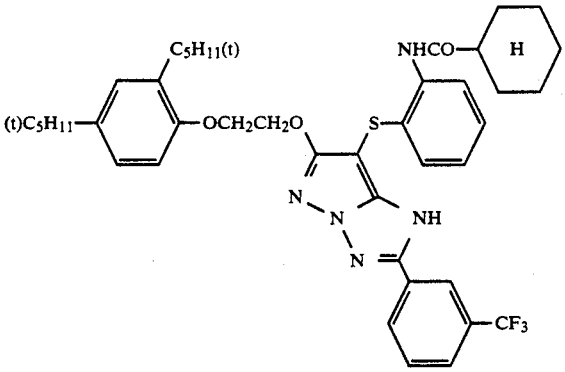
M-29
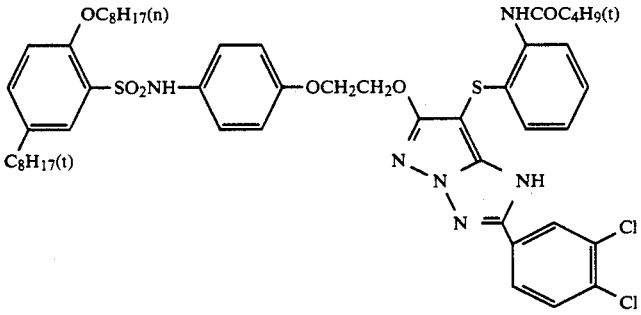
M-30
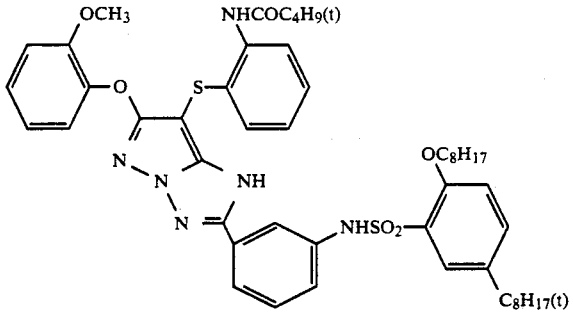
M-31
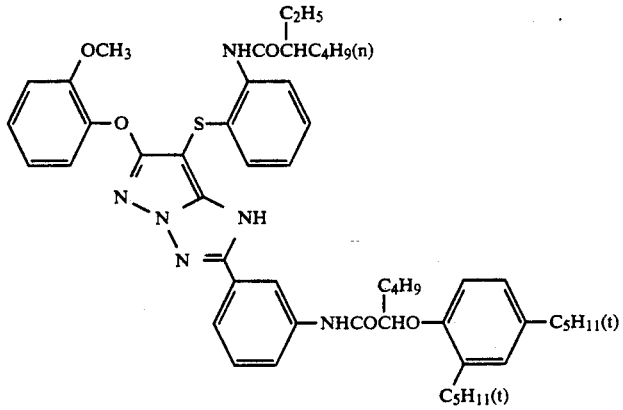

-continued
M-32
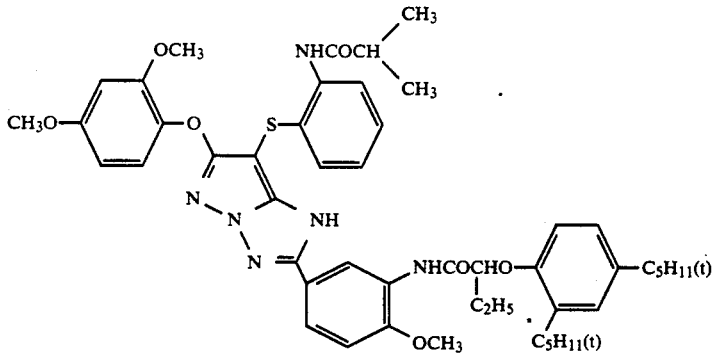
M-33
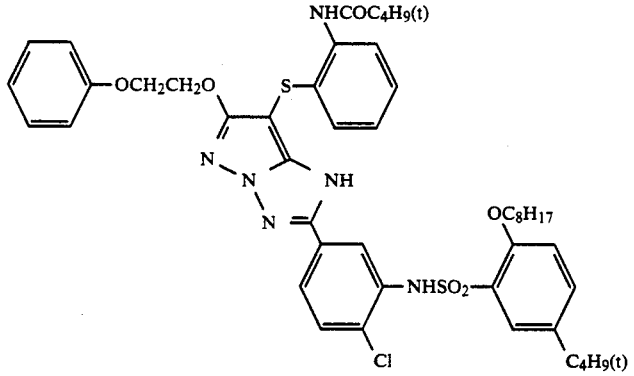
M-34
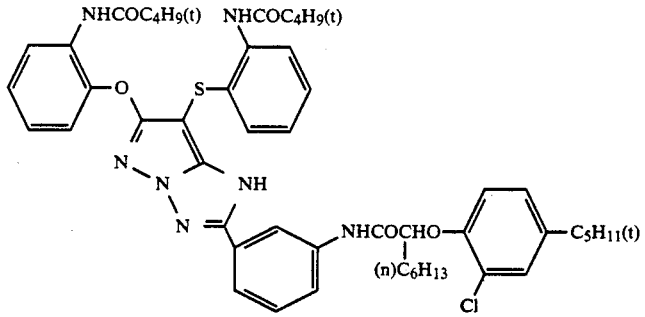
M-35
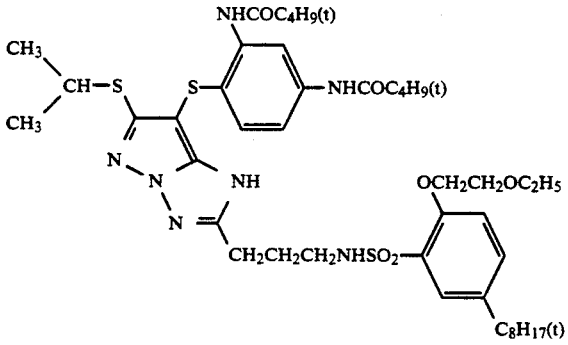

-continued
M-36
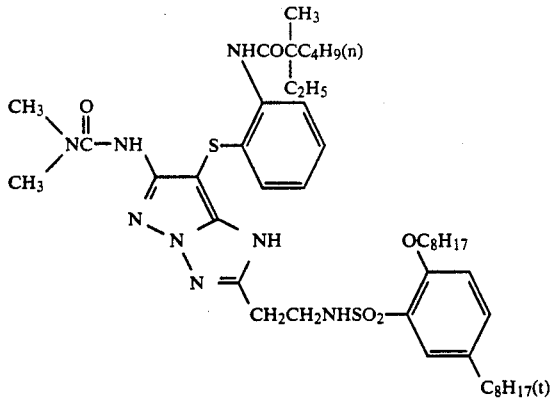
M-37
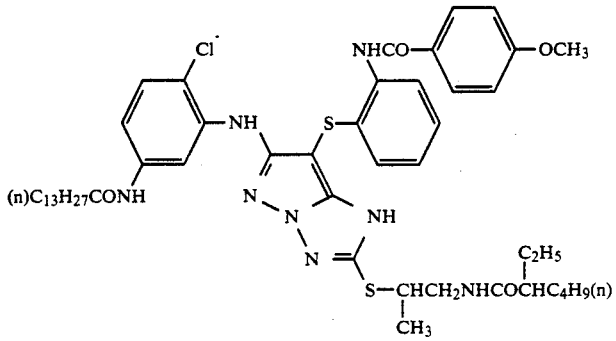
M-38
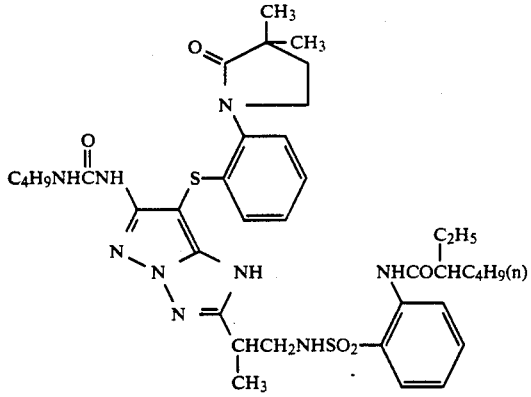
M-39
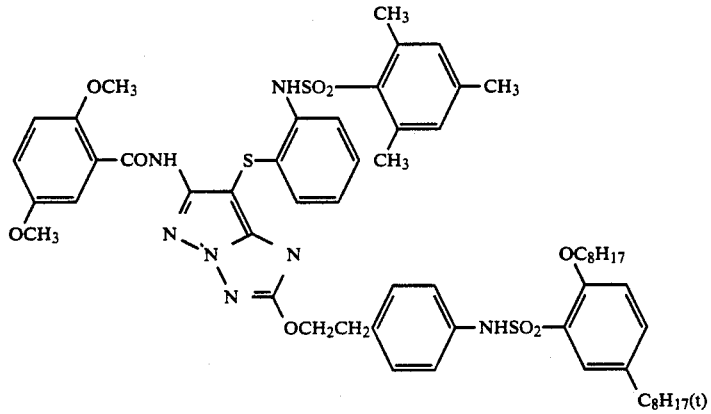

-continued
M-40
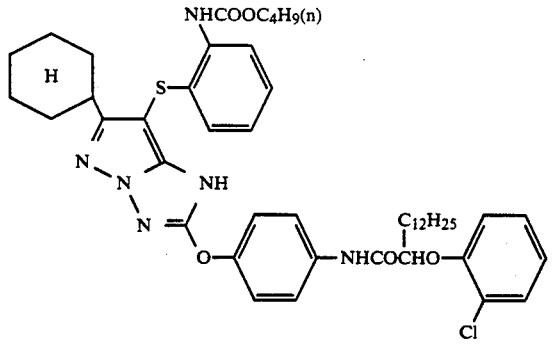
M-41
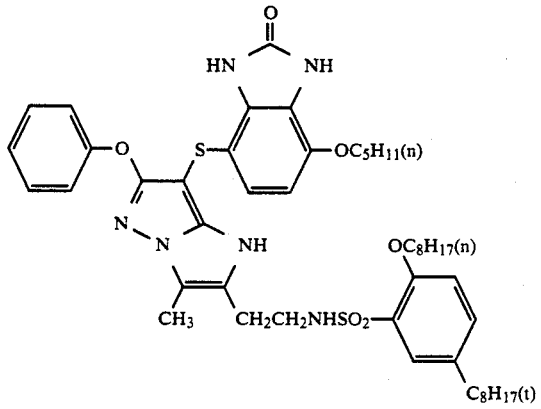
M-43
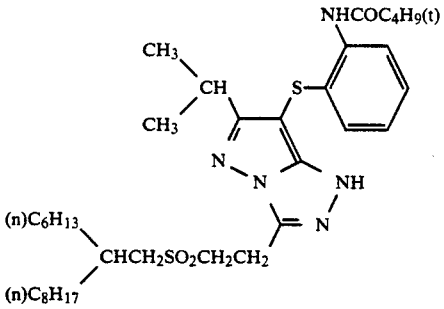
M-44
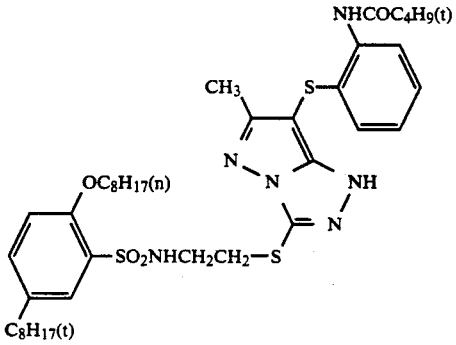

-continued
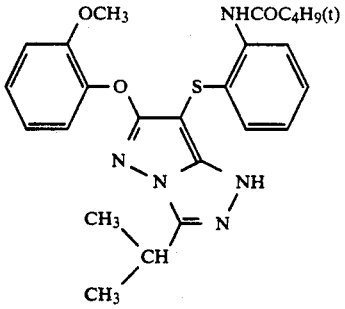
M-45
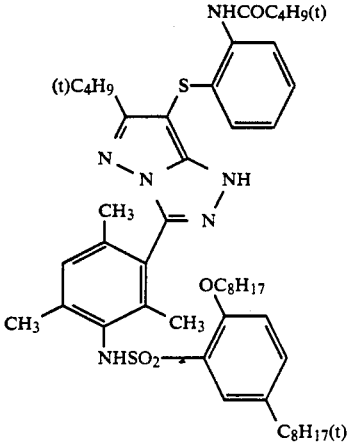
M-46
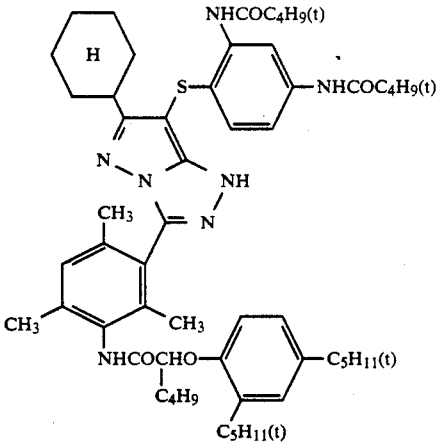
M-47
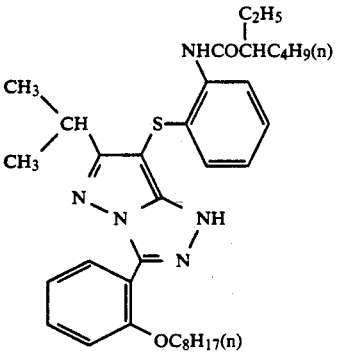
M-48

-continued
M-49
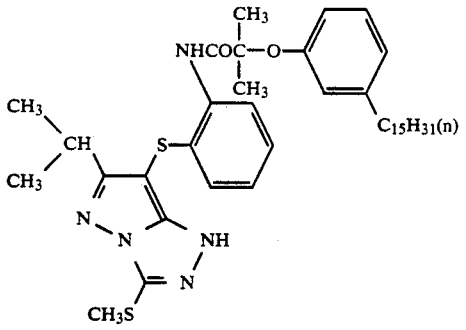
M-50
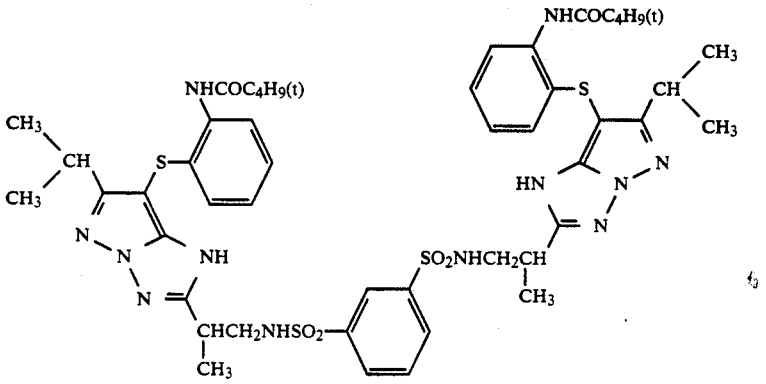
M-51
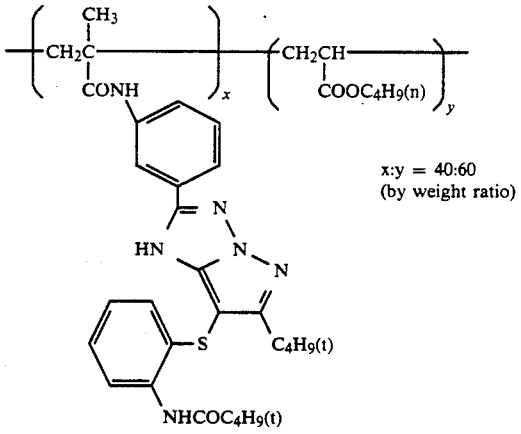
x:y = 40:60
(by weight ratio)
M-52
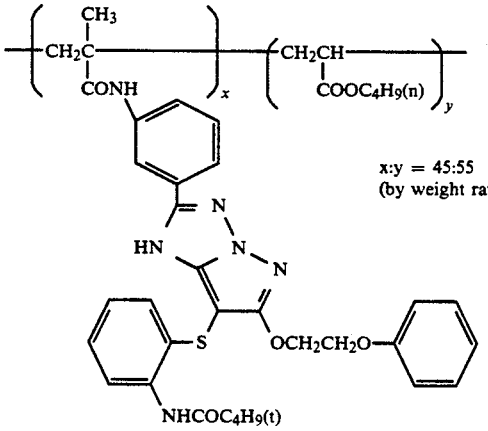
x:y = 45:55
(by weight ratio)

-continued

M-53

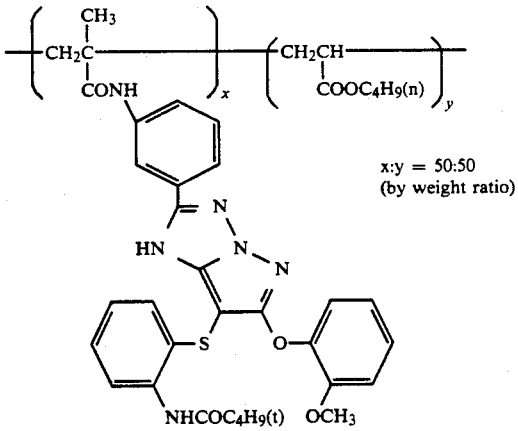

Now, synthesis methods of the magenta couplers according to the present invention are generally described below. Pyrazoloazole couplers wherein the coupling active position is not substituted are synthesized according to known methods. Specifically, 1H-pyrazolo[1,5-b]-1,2,4-triazole skeletons can be synthesized by the method as described in JP-A-59-171956, 1H-pyrazolo[3,2-c]-1,2,4-triazole skeletons can be synthesized by the method as described in U.S. Pat. No. 3,725,067, 1H-imidazo[1,2-b]pyrazole skeletons can be synthesized by the method as described in JP-A 59-62548, and 1H-pyrazolo[1,5-d]tetrazole skeletons can be synthesized by the method as described in JP-A-60-33552.

To introduce a mercapto releasing group to the thus synthesized pyrazoloazole coupler wherein the coupling active position is not substituted, the following synthesis method can be employed. Specifically, a coupler being substituted with an aromatic mercapto group or a heterocyclic mercapto group at the 7-position thereof can be synthesized according to the method as described in U.S. Pat. No. 4,351,897. That is, an arylmercaptan, a heterocyclic mercaptan or a corresponding disulfide is dissolved in a halogenated hydrocarbon solvent, converted into a sulfenyl chloride with chlorine or sulfuryl chloride, and added to an aprotic solvent solution of the four-equivalent magenta coupler, whereby the desired coupler can be synthesized.

Specific example of synthesis of the coupler according to the present invention is illustrated below.

SYNTHESIS EXAMPLE 1

Synthesis of Coupler (M-1)

To a DMF solution (0.02 mol) containing 11.2 g of 6 methyl-2-[1-methyl-2-(octyloxy-5-tert-octylbenzenesulfonamido)ethyl]-1H-pyrazolo[1,5-b]-1,2,4-triazole was added a methylene chloride solution of 2-pivaloylamidophenylsulfenyl chloride which had been prepared by dissolving 4.2 g (0.01 mol) of 2-pivaloylamidophenyldisulfide in 8.0 ml of methylene chloride, adding 1.35 g (0.01 mol) of sulfuryl chloride to the solution at room temperature, and, after the reaction, being concentrated under a reduced pressure to 8 ml. After stirring at 40 to 45° C. for 2 hours, the reaction mixture was extracted with ethyl acetate and dried. The ethyl acetate extract was concentrated, and the residue was recrystallized from a solvent mixture of n-hexane/ethyl acetate to obtain 11.6 g of Coupler (M-1) having a melting point of 112° to 120° C.

| Mass spectrum (FD) | 776 ($M^+$) | | |
|---|---|---|---|
| Elemental analysis | C | H | N |
| Calculated | 64.20 | 8.15 | 10.96 |
| Found | 64.13 | 8.17 | 10.75 |

The coupler according to the present invention is usually employed in a range from $1\times10^{-2}$ mol to 1 mol, preferably from $1\times10^{-1}$ mol to $5\times10^{-1}$ mol, per mol of silver halide.

Color photographic light-sensitive material useful with this invention can have a structure, wherein, on a support at least one blue-sensitive silver halide emulsion layer, at least one green-sensitive silver halide emulsion layer, and at least one red-sensitive silver halide emulsion layer exist. In an ordinary color photographic paper, the silver halide emulsion layers are usually formed on such a support in the aforesaid order but other orders of the emulsion layers may be employed. A color reproduction, by a subtractice color process, can be performed by using silver halide emulsions each having sensitivity to each wavelength region and so-called color couplers forming dyes in complementary color relations with light sensitive to the emulsions, that is, a yellow dye for blue, a magenta dye for green, and a cyan dye for red for the light sensitive emulsion layers. The light-sensitive emulsion layers may not have the aforesaid construction in which they correspond to colored hues of the couplers.

As to the silver halide emulsion for use in this invention, an emulsion composed of a silver halide containing substantially no silver iodide, such as silver chlorobromide and silver chloride is preferably used. The term "containing substantially no silver iodide" means the silver halide wherein the content of silver iodide is 1 mol% or less, and preferably 0.2 mol% or less. The halogen composition of the silver halide emulsion may be different or same among silver halide grains, but when a silver halide emulsion exists having a same halogen composition among the grains, the properties of the silver halide grains can be easily homogenized. Also, as to the halogen composition distribution in the insides of silver halide grains of a silver halide emulsion, so-called homogeneous type structure grains have a same halogen composition in every portions of the silver halide grains; so-called multilayer type structure grains having different halogen compositions between the core or the inside of the silver halide grains and the shell (one layer or plural layers) surrounding the core; or the grains which may have a structure having a non-layer form portion having a different halogen composition in the inside, or on the surface of the silver halide grains (when the portion is at the surface of the grains, the portion having a different composition is junctioned to the edges, corners, or the plane of the grains) may be properly used. For obtaining a high sensitivity, the use of the latter two types of emulsions is more advantageous than the use of the former homogeneous type structure grains and the use of the latter types is also preferred from the view point of pressure resistance. When the silver halide grains have the aforesaid structure, the area between the portions having a different halogen composition may be a distinct boundary, or an indistinct boundary forming mixed crystals by the difference in halogen composition, or may have a continuously changing structure positively formed.

For the halogen composition of the silver chlorobromide emulsion, an optional silver bromide/silver chloride ratio can be employed. The ratio can be selected in a wide range according to the purposes desired, but it is preferred that the proportion of silver chloride is at least 2%.

Also, for the photographic light-sensitive material suitable for quick processing, a so-called high silver chloride emulsion having a high content of silver chloride is preferably used. In such a high silver chloride emulsion, the content of silver chloride is preferably at least 90 mol%, and more preferably at least 95 mol%.

For such a high silver chloride emulsion, the aforesaid structure of having a silver bromide localized phase in the inside of the silver halide grains and/or on the surface thereof inlayer(s) or in non-layer form as described above is preferred. The halogen composition of the aforesaid localized phase is preferably at least 10 mol%, and more preferably over 20 mol% in the content of silver bromide. Also, the silver bromide localized phase can exist in the inside of the silver halide grain, at the edges or corners of the grain surface, or on the plane of the grain surface. However, in a preferred embodiment, such a localized phase is epitaxially grown at the corner portions of the grains.

On the other hand, for inhibiting the reduction of sensitivity in the case of applying a pressure onto the photographic light-sensitive material as completely as possible, it is preferred in a high silver chloride content emulsion having a silver chloride content of at least 90 mol% to use the grains of the homogeneous type structure having a small distribution of the halogen composition in the grains.

Also, for reducing the amount of the replenishers for processing solutions, it is effective to further increase the silver chloride content of the silver halide emulsion. In such a case, an almost pure silver chloride emulsion having a silver chloride content of from 98 mol% to 100 mol% is preferably used.

The mean grain size (shown by the number average of the diameters of circles equivalent to the projected areas of the grains) of the silver halide grains contained in the silver halide emulsion for use in this invention is preferably from 0.1 μm to 2 μm.

Also, the silver halide emulsion for use in this invention is preferably also a so-called monodispersed emulsion having a coefficient of variation (the standard deviation of the grain size divided by the mean grain size) of 20% or less, and preferably 15% or less. In this case, for obtaining a broad latitude, it is preferably practiced to use the aforesaid mono-dispersed emulsion for a same emulsion layer as a blend thereof or to use the aforesaid emulsion as multilayer.

The silver halide grains for use in this invention may have a regular crystal form such as cubic, octahedral, tetradecahedral, etc., an irregular crystal form such as spherical, tabular, etc., or a composite form thereof. Also, the silver halide grains may be a mixture of grains having the various crystal forms. In this invention, it is preferred that the content of the aforesaid regular crystals is at least 50%, preferably at least 70%, and more preferably at least 90%.

Also, a silver halide emulsion wherein the tabular silver halide grains having a mean aspect ratio (i.e., circular-calculated diameter/thickness) of at least 5, and preferably at least 8 is over 50% of the whole grains as the projected area can be preferably used.

The silver chlorobromide emulsions for use in this invention can be prepared using the methods described in P. Glafkides, *Chemie et Physique Photographique*, (published by Paul Montel, 1967), G.F. Duffin, *Photographic Emulsion Chemistry*, (published by Focal Press, 1966), V.L. Zelikman et al, *Making and Coating Photographic Emulsion*, (published by Focal Press, 1964).

That is, the emulsion can be prepared by an acid method, a neutralization method, an ammonia method, etc., and as a method of reacting a soluble silver salt and a soluble halide, a single jet method, a double jet method, or a combination thereof may be employed. A so-called reverse mixing method of forming silver halide grains in the existence of excess silver ions can be also used. As one system of the double jet method, a so-called controlled double jet method of keeping a constant pAg in a liquid phase of forming silver halide grains can be also used. According to the method, a silver halide emulsion containing silver halide grains having a regular crystal form and substantially homogeneous grain sizes can be obtained.

To the silver halide emulsions useful in this invention can be introduced various multivalent metal ion impurities during the formation or physical ripening of the emulsion grains. Examples of such compounds useful in the aforesaid case are salts of cadmium, zinc, lead, copper thallium, etc., or salts or complex salts of the metals belonging to group VIII of the periodic table, such as iron, luthenium, rhodium, palladium, osmium, iridium, platinum, etc. In particular, the salts or complex salts of the metals belonging to group VIII can be preferably used. The addition amount of the aforesaid compound depends upon the purpose but is preferably from $10^{-9}$ to $10^{-2}$ mol per mol of silver halide.

The silver halide emulsions useful in this invention are usually chemically sensitized and spectrally sensitized.

As the chemical sensitization, a sulfur sensitization typified by the addition of an unstable sulfur compound, a noble metal sensitization typified by gold sensitization, and a reduction sensitization can be used solely or as a combination thereof. As the compounds being used for the chemical sensitization, the compounds described in JP-A-62-215272, pages 18 to 22 can be preferably used.

The spectral sensitization is performed by imparting a spectral sensitivity for a desired wavelength region to the silver halide emulsion of each emulsion layer in the photographic light-sensitive material of this invention.

In this invention, it is preferred to perform the spectral sensitization by adding a spectral sensitizing dye, i.e., a dye absorbing light of the wavelength region corresponding to the desired spectral sensitization. Examples of the spectral sensitizing dyes are those described in F.M. Harmer, *Heterocyclic Compounds-Cyanine Dyes and Relates Compounds*, published by John Wiley & Sons, 1964. Specific examples of the spectral sensitizing dyes which can be preferably used in this invention are described in aforesaid JP-A 62-215272, pages 22 to 38.

The silver halide emulsions for use in this invention can contain various compounds or the precursors therefor inhibiting the occurrence of fog during the production, storage, and/or processing of the photographic light-sensitive materials of this invention or stabilizing the photographic performance thereof. They are generally called photographic stabilizers. Specific examples of the preferred compounds are described in aforesaid JP-A-62-215272, pages 39 to 72.

The silver halide emulsion for use in this invention may be a so-called surface latent image type emulsion forming latent images mainly on the surfaces of the silver halide grains or a so-called inside latent image type emulsion forming latent images mainly in the inside of the grain.

For the color photographic light-sensitive material there are usually used a yellow coupler, a magenta coupler and a cyan coupler coloring in yellow, magenta, and cyan, respectively, by causing coupling with the oxidation product of an aromatic primary amine color developing agent.

In yellow couplers for use in this invention, acylacetamide derivatives such as benzoylacetanilide and pivaloylacetanilide are preferred.

In these derivatives, the yellow couplers shown by following formulae (Y-1) and (Y-2) are suitable.

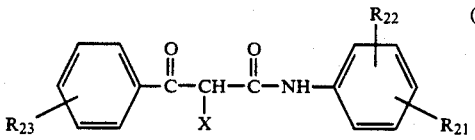

(Y-1)

-continued

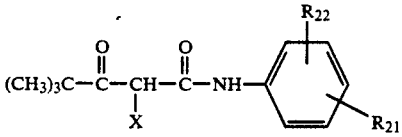

(Y-2)

In the above formulae, X represents a hydrogen atom or a coupling releasable group; $R_{21}$ represents a non-diffusible group having a total carbon atom number of from 8 to 32; $R_{22}$ represents a hydrogen atom, one or more halogen atoms, a lower alkyl group, a lower alkoxy group, or a non-diffusible group having a total carbon atom number of from 8 to 32; $R_{23}$ represents a hydrogen atom or a substituent, and when two or more $R_{23}$s exist, they may be the same or different.

Details of the pivaloylacetanilide type yellow coupler are described in U.S. Pat. No. 4,622,287, from column 3, line 15 to column 8, line 39 and U.S. Pat. No. 4,623,616, from column 14, line 50 to column 19, line 41.

Details of the benzoylacetanilide type yellow coupler are described in U.S. Pat. Nos. 3,408,194, 3,933,501, 4,046,575, 4,133,958, and 4,401,752.

As specific examples of the pivaloylacetanilide type yellow coupler, are Compounds (Y-1) to (Y-39) described in U.S. Pat. No. 4,622,287, column 37 to column 54. In these compounds, Compounds (Y-1), (Y-4), (Y-6), (Y-7), (Y-15), (Y-21), (Y-22), (Y-23), (Y-26), (Y-35), (Y-36), (Y-37), (Y-38), and (Y 39) are preferred.

Also, other specific examples of the yellow coupler are Compounds (Y-1) to (Y-33) described in aforesaid U.S. Pat. No. 4,623,616, column 19 to column 24 and in these compounds, Compounds (Y 2), (Y-7), (Y-8), (Y-12), (Y-20), (Y-21), (Y-23), and (Y-29) are preferred.

Other preferred yellow couplers are Compound (34) described in U.S. Pat. No. 3,408,194, column 6, Compounds (16) and (19) described in U.S. Pat. No. 3,933,501, column 8, Compound (9) described in U.S. Pat. No. 4,046,575, columns 7 to 8, Compound (1) described in U.S. Pat. No. 4,133,958, columns 5 to 6, Compound 1 described in U.S. Pat. No. 4,401,752, column 5, and following compounds a) to h).

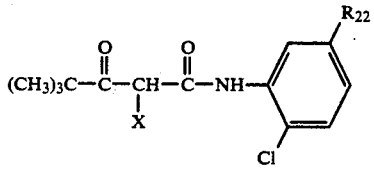

| Compound | $R_{22}$ | X |
|---|---|---|
| a | $-COOCH(CH_3)COOC_{12}H_{25}$ | 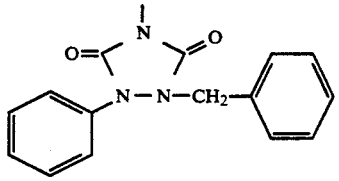 |

-continued

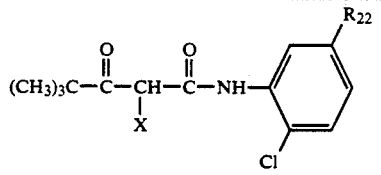

| Compound | $R_{22}$ | X |
|---|---|---|
| b | $-COOCH(C_4H_9)COOC_{12}H_{25}$ | 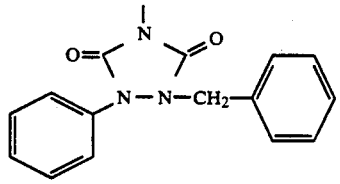 |
| c | 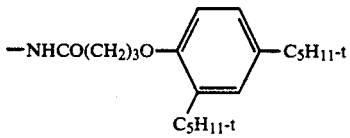 | 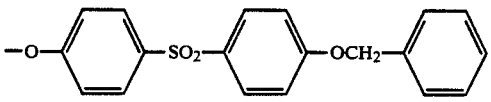 |
| d | 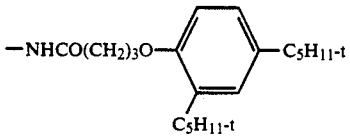 | 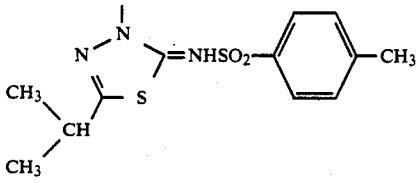 |
| e | 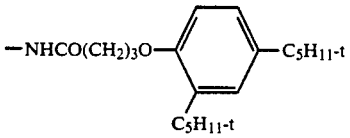 | 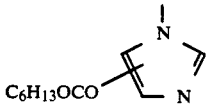 |
| f | $-NHSO_2C_{12}H_{25}$ | 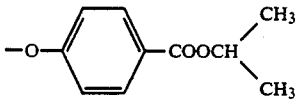 |
| g | $-NHSO_2C_{16}H_{33}$ | 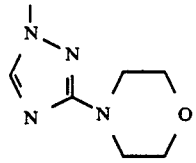 |
| h | $-NHCO-CH(CH_3)-CH_2SO_2C_{12}H_{25}$ | 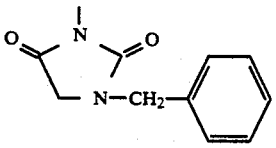 |

In the aforesaid couplers, the couplers having a nitrogen atom as a releasable atom are particularly preferred.

Also, as other magenta couplers which can be used together with the pyrazolone series magenta couplers defined in this invention, there are oil-protect type indazolone series and cyanoacetyl series magenta couplers, and preferably 5-pyrazolone series magenta couplers and pyrazoloazole series magenta couplers such as pyrazolotriazoles. In the 5-pyrazolone series magenta couplers, the couplers having an arylamino group or an acylamino group at the 3-position are preferred with respect to the hue and color density of colored dyes. Specific examples thereof are described in U.S. Pat. Nos. 2,311,082, 2,343,703, 2,600,788, 2,908,573, 3,062,653, 3,152,896, and 3,936,015. As the releasable group for the 2-equivalent 5-pyrazolone series magenta couplers, the nitrogen atom releasable groups described in U.S. Pat. No. 4,310,619 and the arylthio groups described in U.S. Pat. No. 4,351,897 and WO 88/04795 are preferred. Also, 5-pyrazolone series magenta couplers having a ballast group described in European Patent 73,636 give high coloring density.

Pyrazoloazole series magenta couplers include pyrazolobenzimidazoles described in U.S. Pat. No. 2,369,879, preferably pyrazolo[5,1 c][1,2,4]triazoles described in U.S. Pat. No. 3,725,067, pyrazolotetrazoles described in *Research Disclosure*, No. 24220 (June 1984), and pyrazolopyrazoles described in *Research Disclosure*, No. 24230, (June 1984). The aforesaid couplers may be polymer couplers.

Specific examples of these magenta couplers are those shown by following general formula (M-1), (M-2), or (M-3).

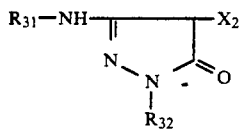
(M-1)

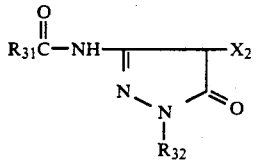
(M-2)

-continued

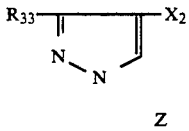
(M-3)

In the above formulae, $R_{31}$ represents a non-diffusible group having total carbon atom number of from 8 to 32; $R_{32}$ represents a phenyl group or a substituted phenyl group; $R_{33}$ represents a hydrogen atom or a substituent; Z represents a non-metallic atomic group necessary for forming a 5-membered azole ring including from 2 to 4 nitrogen atoms, said azole ring may have a substituent (including a condensed ring); and $X_2$ represents a hydrogen atom or a releasable group. Details of the substituent for $R_{33}$ and the substituent for the azole ring are described in U.S. Pat. No. 4,540,654, column 2, line 41 to column 8, line 27.

In the pyrazoloazole series magenta couplers, the imidazo[1,2-b]pyrazoles described in U.S. Pat. No. 4,500,630 are preferred and pyrazolo[1,5-b][1,2,4]triazole described in U.S. Pat. No. 4,540,654 are particularly preferred from the points of less yellow side absorption and light fastness of the colored dye formed thereof.

Other examples of the pyrazoloazole series couplers are the pyrazolotriazole couplers wherein a branched alkyl group is directly bonded to the 2, 3, or 6-position of the pyrazolotriazole ring as described in JP-A-61-65245, the pyrazoloazole couplers having a sulfonamido group in the molecule as described in JP-A-61-65246, the pyrazoloazole couplers having an alkoxyphenylsulfonamide ballast group as described in JP-A-61-147254, and the pyrazolotriazole couplers having an alkoxy group or an aryloxy group at the 6-position as described in European Patent (unexamined published) Application 226,849.

Specific examples of these magenta couplers are illustrated below.

| Compound | $R_{33}$ | $R_{34}$ | $X_2$ |
|---|---|---|---|
| | | 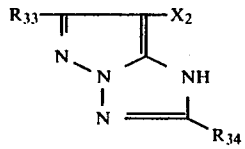 | |
| M'-1 | $CH_3$— | 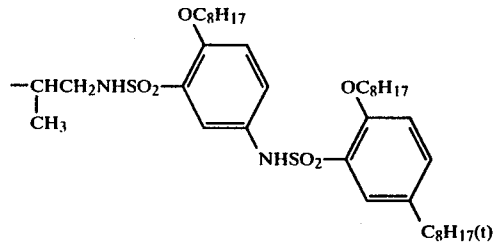 | Cl |
| M'-2 | $CH_3$— | 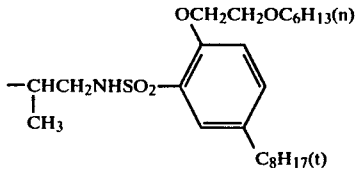 | Cl |
| M'-3 | $CH_3$— | 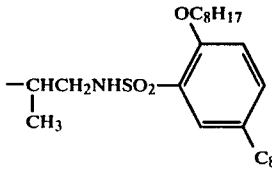 | 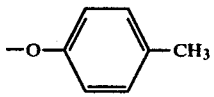 |
| M'-4 | 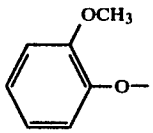 | 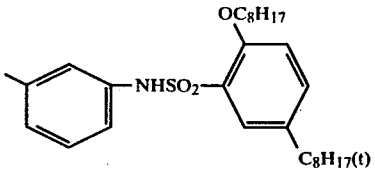 | 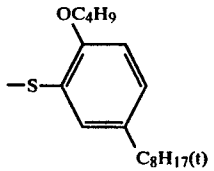 |

-continued
| Compound | $R_{33}$ | $R_{34}$ | $X_2$ |
|---|---|---|---|
| M'-5 | $CH_3$— | 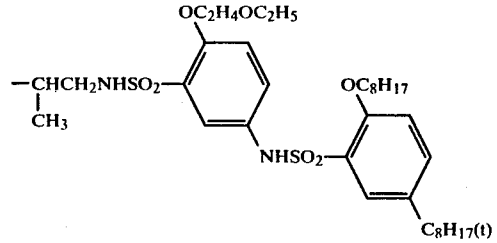 | Cl |
| M'-6 | $CH_3$— | 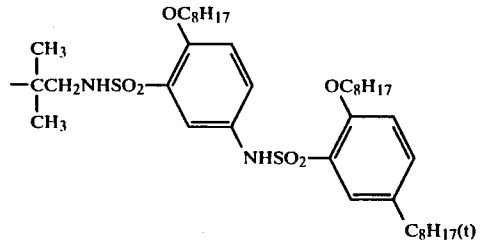 | Cl |
| M'-7 | 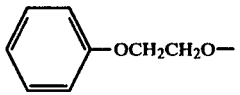 | 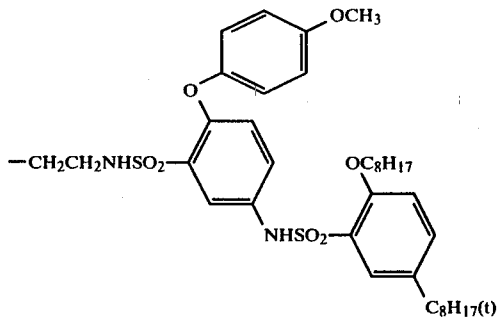 | 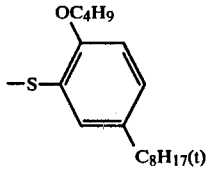 |
| M'-8 | $CH_3CH_2O$— | as above | as above |
| M'-9 | 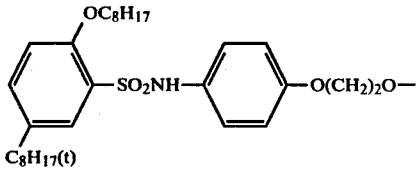 | 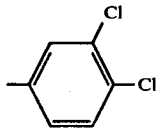 | 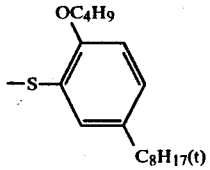 |

-continued
| Compound | $R_{33}$ | $R_{34}$ | $X_2$ |
|---|---|---|---|
| | 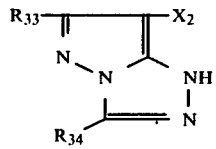 | | |
| M'-10 | 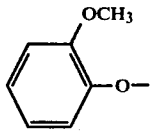 | 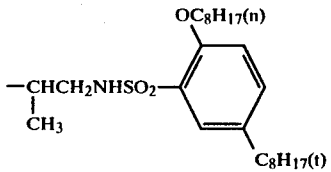 | Cl |
| M'-11 | $CH_3$— | 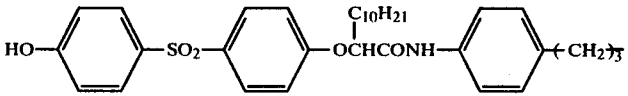 | Cl |
| M'-12 | $CH_3$— | 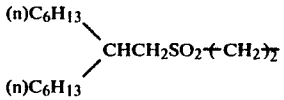 | Cl |
| M'-13 | 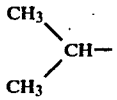 | 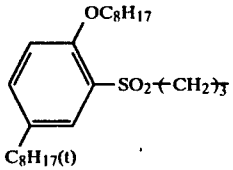 | Cl |
| M'-14 | 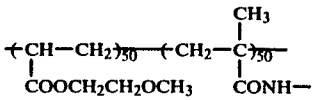 | 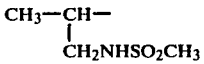 | as above |

-continued
| Compound | $R_{33}$ | $R_{34}$ | $X_2$ |
|---|---|---|---|
| M'-15 | 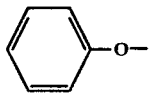 | 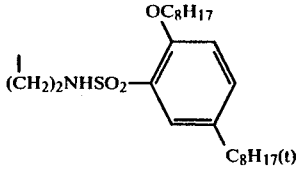 | Cl |
| M'-16 | 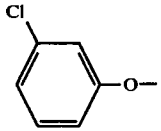 | 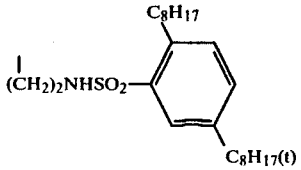 | 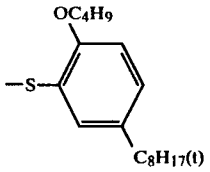 |

As the cyan couplers for use in this invention, phenolic cyan couplers and naphtholic cyan couplers are most typical.

As the cyan couplers, there are the cyan couplers (including polymer couplers) having an acylamino group at the 2-position of the phenol nucleus and an alkyl group at the 5-position thereof as described in U.S. Pat. Nos. 2,369,929, 4,518,687, 4,511,647, and 3,772,002 and specific examples thereof are the coupler in Example 2 described in Canadian Patent 625,822, Compound (1) described in U.S. Pat. No. 3,772,002, Compounds (I-4) and (I-5) described in U.S. Pat. No. 4,564,590, Compounds (1), (2), (3), and (24) described in JP-A-61-39045, and Compound (C-2) described in JP-A-62-70846.

As the phenolic cyan coupler, there are 2,5-diacylaminophenolic couplers described in U.S. Pat. No. 2,772,162, 2,895,826, 4,334,011, and 4,500,653, and JP-A-59-164555 and specific examples thereof are Compound (V) described in U.S. Pat. No. 2,895,826, Compound (17) described in U.S. Pat. No. 4,557,999, Compounds (2) and (12) described in U.S. Pat. No. 4,565,777, Compound (4) described in U.S. Pat. No. 4,124,396 and Compound (I-19) described in U.S. Pat. No. 4,613,564.

As other phenolic cyan couplers, there are the cyan couplers wherein a nitrogen-containing heterocyclic ring is condensed to the phenol nucleus as described in U.S. Pat. Nos. 4,372,173, 4,564,586, and 4,430,423, JP-A-61-390441, and Japanese Patent Application No. 61-100222 and specific examples thereof are Couplers (1) and (3) described in U.S. Pat. No. 4,327,173, Compounds (3) and (16) described in U.S. Pat. No. 4,564,586, Compounds (1) and (3) described in U.S. Pat. No. 4,430,423 and also the following compounds.

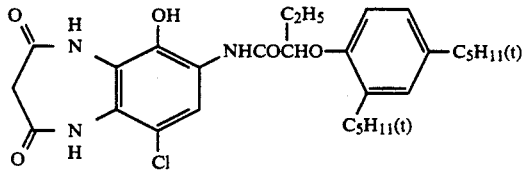

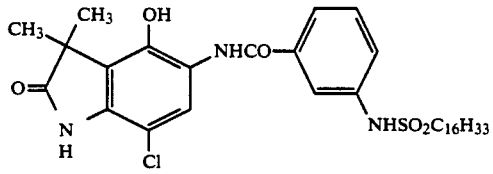

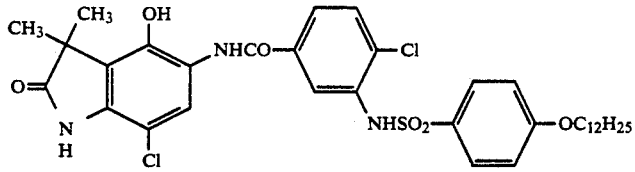

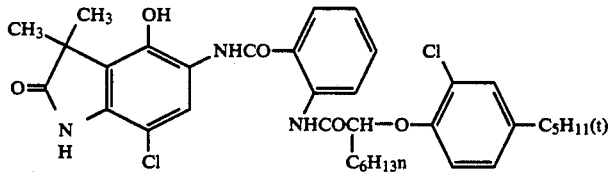

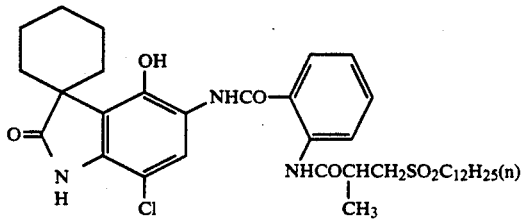

-continued
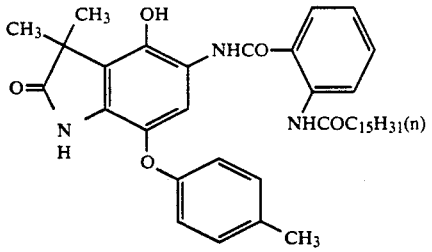
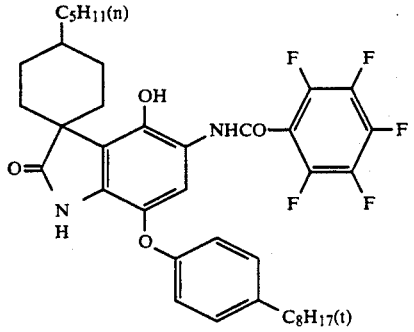
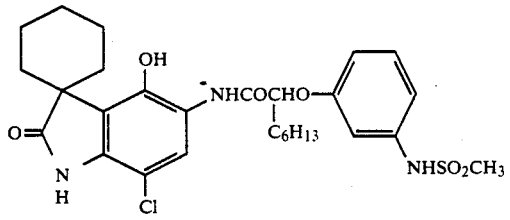
As other cyan couplers than the aforesaid cyan couplers, there are the diphenylimidazole series cyan couplers described in European Patent (unexamined published) Application EP 0,249,453A2, such as shown below.
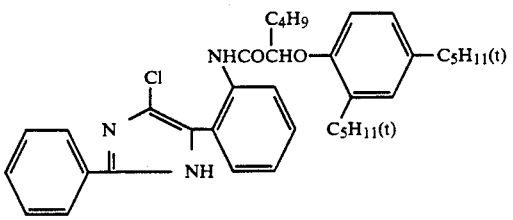
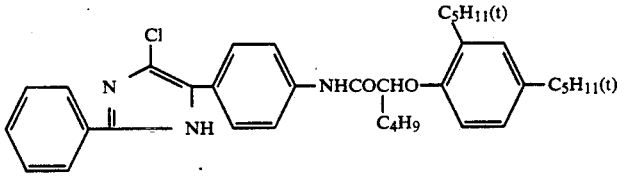
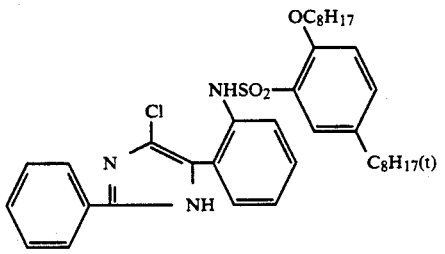

-continued

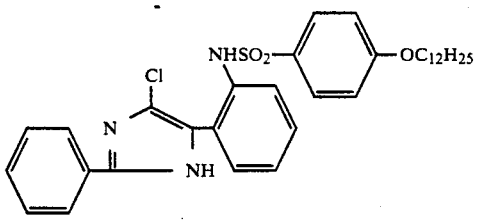

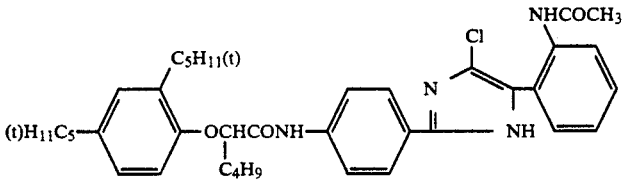

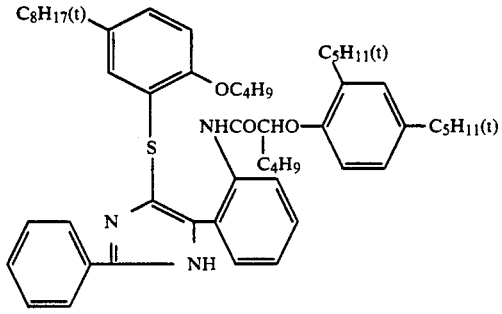

As still other phenolic cyan couplers, there are the ureido series cyan couplers described in U.S. Pat. Nos. 4,333,999, 4,451,559, 4,444,872, 4,427,767, 4,579,813, and European Patent (EP) 067,689B1 and specific examples thereof are Coupler (7) described in U.S. Pat. No. 4,333,999, Coupler (1) described in U.S. Pat. No. 4,451,559, Coupler (14) described in U.S. Pat. No. 4,444,872, Coupler (3) described in U.S. Pat. No. 4,427,767, Couplers (6) and (24) described in U.S. Pat. No. 4,609,619, Couplers (1) and (11) described in U.S. Pat. No. 4,579,813, Couplers (45) and (50) described in European Patent (EP) 067,689B1, and Coupler (3) described in JP-A-61-42658.

As the naphtholic cyan couplers for use in this invention, there are cyan couplers having an N-alkyl-N-arylcarbamoyl group at the 2-position of the naphthol nucleus as described in U.S. Pat. No. 2,313,586, the cyan couplers having an alkylcarbamoyl group at the 2-position of the naphthol nucleus as described in U.S. Pat. Nos. 2,474,293 and 4,282,312, the cyan couplers having an arylcarbamoyl group at the 2-position of the naphthol nucleus as described in JP-B-50-14523 (the term "JP-B" as used herein means an "examined published Japanese patent application"), the cyan couplers having a carbonamido group or a sulfonamido group at the 5-position of the naphthol nucleus as described in JP-A-60-237448, 61-145557, and 61-153640), the cyan couplers having an aryloxy releasable group as described in U.S. Pat. No. 3,476,563, the cyan couplers having a substituted alkoxy releasable group as described in U.S. Pat. No. 4,296,199, and the cyan couplers having a glycol acid releasable group as described in JP-A-60-39217.

These couplers can be incorporated in a silver halide emulsion layer by dispersing in the emulsion with at least one of high-boiling organic solvents, such as, preferably the high boiling organic solvents shown by following formulae (A) to (E);

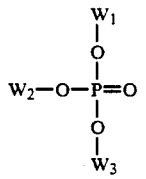

(A)

$W_1-COO-W_2$ (B)

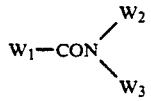

(C)

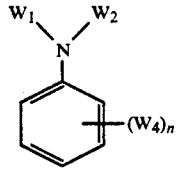

(D)

$W_1-O-W_2$ (E)

In the above formulae, $W_1$, $W_2$, and $W_3$ each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group; $W_4$ represents $W_1$, $OW_1$, or $S-W_1$; and n represents an integer of from 1 to 5, when n is 2 or more, $W_4$s may be the same or different, and in formula (E), $W_1$ and $W_2$ may combine with each other to form a condensed ring.

The organic solvents having a high boiling point are described in detail in JP-A-62 215272, page 137, right lower column to page 144, right upper column.

Further, these couplers can be emulsified or dispersed in an aqueous solution of a hydrophilic colloid by loading them into a loadable latex polymer (such as those described in U.S. Pat. No. 4,203,716) in the presence of or in the absence of the above described organic solvent having a high boiling point, or dissolving them in a water-insoluble and organic solvent-soluble polymer.

As the polymers, the homopolymers or copolymers described in PCT Application (unexamined published) WO 88/00723, pages 12 to 30 are used, and in particular, acrylamide series polymers are preferred with respect to color image stability.

The photographic light-sensitive materials of this invention may contain hydroquinone derivatives, aminophenol derivatives, gallic acid derivatives, ascorbic acid derivatives, etc., as color fog inhibitors.

For the photographic light-sensitive materials of this invention can be used various fading inhibitors. That is, an organic fading inhibitors for cyan, magenta, and/or yellow images, -there are hydroquinones, 6-hydroxychromans, 5-hydroxycoumarans, spirochromans, spiroindanes, p-alkoxyphenols, hindered phenols (such as bisphenols), gallic acid derivatives, methylenedioxybenzenes, aminophenols, hindered amines, and the ether or ester derivatives obtained by silylating or alkylating the phenolic hydroxy groups of the aforesaid compounds. Also, metal complexes such as (bissalicylaldoxymate)-nickel complexes and (bis-N,N-dialkyldithiocarbamate)nickel complexes can be used.

Specific examples of the organic fading inhibitors described above are as follows.

That is, the hydroquinones are described in U.S. Pat. Nos. 2,360,290, 2,418,613, 2,700,453, 2,701,197, 2,728,659, 2,732,300, 2,735,765, 3,982,944, and 4,430,425, British Patent 1,363,921, U.S. Pat. Nos. 2,710,801 and 2,816,028; the 6-hydroxychromans, 5-hydroxycoumarans, and spirochromans are described in U.S. Pat. Nos. 3,432,300, 3,573,050, 3,574,627, 3,698,909, and 3,764,337, and JP-A-52-152225; the spiroindanes are described in U.S. Pat. No. 4,360,589; the p-alkoxyphenols are described in U.S. Pat. No. 2,735,765, British Patent 2,066,975, JP-A-59 10539, JP-B 57 19765; the hindered phenols are described in U.S. Pat. Nos. 3,700,455 and 4,228,235, JP-A-52-72224,- and JP B-52-6623; the gallic acid derivatives, methylenedioxybenzenes, and amino-phenols are described in U.S. Pat. Nos. 3,457,079 and 4,332,886, and JP-B-56-21144, respectively; the hindered amines are described in U.S. Pat. Nos. 3,336,135 and 4,268,593, British Patents 1,326,889, 1,354,313, and 1,410,846, JP-B-51-1420 and JP-A-58-114036, JP-A-59-53846, and JP-A-59-78344; the ether and ester derivatives of the phenolic hydroxy groups are described in U.S. Pat. Nos. 4,155,765, 4,174,220, 4,254,216, 4,264,720, and 4,279,990, JP-A-54-145530, JP-A-55-6321, JP-A-58-105147, and JP-A-59-10539, JP-B-57-37856 and JP-B-53-3263; and the metal complexes are described in U.S. Pat. Nos. 4,050,938 and 4,241,155 and British Patent 2,027,731A.

By incorporating the aforesaid compounds in an emulsion with each corresponding color coupler in an amount of from 5 to 100% by weight based on the amount of the color coupler in each light-sensitive emulsion layer, objects of the present invention can be attained.

For inhibiting the deterioration of cyan dye images by heat and, in particular, light, it is effective to introduce a ultraviolet absorbent in layers adjacent to both the surfaces of a cyan coloring emulsion layer.

In the aforesaid fading inhibitors, spiroindanes and hindered amines are particularly preferred.

In accordance with the present invention, it is preferred to employ the compounds as described below together with the above described couplers, particularly pyrazoloazole couplers. More specifically, to employ individually, or in combination, a compound (F) which is capable of forming a chemical bond with the aromatic amine developing agent remaining after color development to give a chemically inactive and substantially colorless compound and/or a compound (G) which is capable of forming a chemical bond with the oxidation product of the aromatic amine developing agent remaining after color development to give a chemically inactive and substantially colorless compound, is preferred in view of the desirability of preventing the occurrence of stain and other undesirable side-effects resulting from the formation of colored dye upon a reaction of the color developing agent (or oxidation product thereof) which remains in the photographic layer with the coupler during preservation of the photographic material after processing.

Among the compounds (F), those capable of reacting with p-anisidine at a second order reaction rate constant $k_2$ (in trioctyl phosphate at 80° C.) of from 1.0 liter/mol·sec. to $1\times10^{-5}$ liter/mol·sec. are preferred.

When the constant $k_2$ is large than this range, the compounds per se are unstable and may react with gelatin or water, or decompose. On the other hand, when the constant $k_2$ is smaller than the above described range, the reaction rate in the reaction with the remaining aromatic amine developing agent is low, and as a result, the degree of prevention of the side-effect due to the remaining aromatic amine developing agent, which is the object of the use, tends to be reduced.

Of the Compounds (F), those more preferred are represented by the following general formula (FI) or (FII):

$$R_1-(A)_n-X \qquad \text{(FI)}$$

$$R_2-\underset{\underset{B}{|}}{C}=Y \qquad \text{(FII)}$$

wherein $R_1$ and $R_2$ each represents an aliphatic group, an aromatic group or a heterocyclic group; X represents a group to be released by a reaction with an aromatic amine developing agent; A represents a group forming a chemical bond by a reaction with an aromatic amine developing agent; n represents 0 or 1; B represents a hydrogen atom, an aliphatic group, an aromatic group, a heterocyclic group, an acyl group or a sulfonyl group; Y represents a group capable of accelerating the addition of an aromatic amine developing agent to the compound represented by the general formula (FII); or $R_1$ and X, or Y and $R_2$ or B may combine with each other to form a cyclic structure.

Of the reactions utilized for forming a chemical bond with the remaining aromatic amine developing agent, a substitution reaction and an addition reaction are typical reactions.

Specific examples of the compounds represented by the general formulae (FI) or (FII) are described, for example, in JP-A-63 158545, JP-A-62-283338, EP-A-298321 and EP-A-277589.

On the other hand, of compounds represented by the general formula (G) producing chemically inactive and colorless compounds by a reaction with an oxidation product of aromatic amine developing agent ramaining after color development, preferable compounds are represented by the general formula (GI):

$$R—Z \qquad (GI)$$

wherein R represents an aliphatic group, an aromatic or a heterocyclic group; Z represents a nucleophilic group or a group releasing a nucleophilic group by a decomposition in a photographic material.

Preferable compounds represented by (GI) include compounds which include, as Z, a group having 5 or more of a nucleophilic $nCH_3I$ value which is defined in R.G. Pearson, et al., *J. Am. Chem. Soc.*, 90, 319 (1968) or a group derived therefrom.

Preferable compounds represented by the general formula (GI) are described in EP-A-255722, EP-A-298321 and EP-A-277589, JP-A-62 143048 and JP-A-62-229145, and Japanese Patent Application Nos. 63-136724 and 62-214681.

Further, the combination use of the compounds represented by the general formula (F) and the compounds represented by the general formula (G) is described in detail in JEP-A-277589.

The color photographic light-sensitive material according to the present invention may contain an ultraviolet light absorbing agent in the hydrophilic colloid layer. Suitable examples of the ultraviolet light absorbing agents used include aryl group-substituted benzotriazole compounds (for example, those as described in U.S. Pat. No. 3,533,794), 4-thiazolidone compounds (for example, those as described in U.S. Pat. Nos. 3,314,794 and 3,352,681), benzophenone compounds (for example, those as described in JP A-46-2784), cinnamic acid ester compounds (for example, those as described in U.S. Pat. Nos. 3,705,805 and 3,707,375), butadiene compounds (for example, those as described in U.S. Pat. No. 4,045,229), and benzoxazole compounds (for example, those as described in U.S. Pat. No. 3,700,455). Furthermore, ultarviolet light absorptive couplers (for example, α-naphtholic cyan dye forming couplers) or ultraviolet light absorptive polymers may be used as ultraviolet light absorbing agents. These ultraviolet light absorbing agents may be mordanted in a specific layer.

The photographic light-sensitive material according to the present invention may contain water-soluble dyes as filter dyes or for irradiation prevention or other various purposes in the hydrophilic colloid layers. Examples of such water-soluble dyes include oxonol dyes, hemioxonol dyes, styryl dyes, merocyanine dyes, cyanine dyes, and azo dyes. In these dyes, oxonol dyes, hemioxonol dyes, and merocyanine dyes are useful.

As the binder or protective colloids which can be used for the emulsion layers of the color photographic light-sensitive material according to the present invention, gelatin is advantageously used, but other hydrophilic colloids can be used alone or together with gelatin.

As gelatin, lime-treated gelatin or acid-treated gelatin can be used in the present invention. Details of the production of gelatin are described in Arther Weiss, *The Macromolecular Chemistry of Gelatin*, published by Academic Press, 1964.

As the support used in the present invention, there are those conventionally employed in photographic light-sensitive materials, for example, transparent films such as cellulose nitrate films and polyethylene terephthalate films, or reflective supports. For the purpose of the present invention, reflective supports are rather preferably employed.

The term "reflective support" which can be employed in the present invention means a support having an increased reflection property for the purpose of rendering dye images formed in the silver halide emulsion layer clear. Examples of the reflective support include a support having coated thereon a hydrophobic resin containing a light reflective substance such as titanium oxide, zinc oxide, calcium carbonate, or calcium sulfate dispersed therein and a support composed of a hydrophobic resin containing a light reflective substance dispersed therein. More specifically, they include baryta coated paper; polyethylene coated paper; polypropylene type synthetic paper; transparent supports, for example, a glass plate, a polyester film such as a polyethylene terephthalate film, a cellulose triacetate film and a cellulose nitrate film, a polyamide film, a polycarbonate film, a polystyrene film, or a vinyl chloride resin, having a reflective layer or having incorporated therein a reflective substance. A suitable support can be appropriately selected depending on the purpose of use.

As the light reflective substance, white pigments thoroughly kneaded in the presence of a surface active agent are employed, and pigments the surface of which have been treated with a divalent, trivalent or tetravalent alcohol are preferably used.

The occupied area ratio (%) per a definite unit area of fine white pigment particles can be determined in the following typical manner. Specifically, the area observed is divided into the unit area of 6 μm×6 μm adjacent to each other, and the occupied area ratio (Ri) (%) of the fine particle projected on the unit area was measured. The coefficient of variation of the occupied area ratio (%) can be obtained by a ratio of $s/\overline{R}$ wherein s is a standard deviation of Ri and $\overline{R}$ is an average value of Ri. A number (n) of the unit area subject is preferably 6 or more. Thus, the coefficient of variation ($s/\overline{R}$) is obtained by the following equation:

$$\sqrt{\frac{\sum_{i=1}^{n}(Ri-\overline{R})^2}{n-1}} \Big/ \frac{\sum_{i=1}^{n} Ri}{n}$$

In the present invention, the coefficient of variation of the occupied area ratio (%) of fine pigment particles is preferably not more than 0.15, particularly preferably not more than 0.12. When the value is not more than 0.08, the dispersibility of particles can be designated as substantially uniform.

The color developing solution used in the present invention contains a known aromatic primary amine color developing agent. Preferred examples thereof are p-phenylenediamine derivatives. Typical examples of the p-phenylenediamine derivative used are set forth below, but the present invention should not be construed as being limited thereto.

D-1: N,N-Diethyl-p-phenylenediamine

D-2: 2-Amino-5-diethylaminotoluene

D-3: 2-Amino-5-(N-ethyl N-laurylamino)toluene
D-4: 4-[N-Ethyl-N-(β-hydroxyethyl)amino]aniline
D-5: 2-Methyl-4-[N-ethyl-N-(β-hydroxyethyl)amino]-aniline
D-6: 4-Amino-3-methyl-N-ethyl-N-[β-(methanesulfonamido)ethyl]aniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Of these p phenylenediamine derivatives, 4-amino-3-methyl-N-ethyl-N-[β-(methanesulfonamido)ethyl]-aniline (D-6) is particularly preferred.

These p-phenylenediamine derivatives may be in the form of salts such as sulfates, hydrochlorides, sulfites, or p toluenesulfonates.

The aromatic primary amine developing agent is used in an amount of from about 0.1 g to about 20 g and preferably from about 0.5 g to about 10 g per liter of the developing solution.

Also, the color developing solution used in the present invention may contain, if desired, sulfites such as sodium sulfite, potassium sulfite, sodium bisulfite, potassium bisulfite, sodium metasulfite, and potassium metasulfite, or carbonyl-sulfite adducts, as preservatives.

However, in case of using a color developing solution free from benzyl alcohol for the purpose of reducing load, or for preventing environmental pollution, it is preferred that the color developing solution does not substantially contain a sulfite ion, in order to improve color forming property thereof. In such a system, the effect of the present invention is particularly remarkable. The terminology "color developing solution does not substantially contain a sulfite ion" as used herein means that the color developing solution contains not more than 0.5 g, preferably not more than 0.2 g of sulfite ion in terms of sodium sulfite per liter of the solution. It is more preferred that the color developing solution does not contain sulfite ions at all.

Further, it is preferred to add, as compounds capable of directly preservating the color developing agent, various hydroxylamines, hydroxamic acids as described in Japanese Patent Application No. 61-186559, hydrazines and hydrazides as described in Japanese Patent Application No. 61-170756, phenols as described in JP-A-63-44657 and JP-A-63-58443, α-hydroxyketones and α-aminoketones as described in JP-A-63-44656 and/or various saccharides as described in JP-A-63-36244 to the color developing solution. Moreover, together with the above described compounds, monoamines as described in Japanese Patent Application No. 61-164515 and JP-A-63-21647, JP-A-63-4235, JP-A-63 24254, JP-A-63-27841 and JP-A-63-25654, etc., diamines as described in Japanese Patent Application No. 61-164515, JP-A 63 30845 and JP-A-63-43139, etc., polyamines as described in JP-A-63-21647 and JP-A-63-26655, polyamines as described in JP-A-63-44655, nitroxy radicals as described in JP-A-63-53551, alcohols as described in JP-A 63-43140 and JP-A-63-53549, oximes as described in JP-A-63-56654, and tertiary amines as described in Japanese Patent Application No. 61-265149 are preferably employed.

Other preservatives such as various metals as described in JP-A 57-44148 and JP-A-57-53749, salicylic acids as described in JP-A-59-180588, alkanolamines as described in JP-A-54-3532, polyethyleneimines as described in JP-A-56-94349, or aromatic polyhydroxy compounds as described in U.S. Pat. No. 3,746,544, may be incorporated into the color developing solution, if desired. Particularly, the addition of alkanol amines such as triethanolamine, dialkylhydroxylamines such as diethylhydroxylamine of aromatic polyhydroxy compounds is preferred.

The color developing solution used in the present invention has a pH which ranges preferably not more than 12 and more preferably from 9 to 11.0. The color developing solution may also contain any of the compounds that are known to be usable as components of developing solutions.

In order to maintain the pH in the above-described range, various kinds of buffers are preferably employed. Suitable examples of these buffers include carbonates, phosphates, borates, tetraborates, hydroxybenzoates, glycine salts, N,N,-dimethylglycine salts, leucine salts, norleucine salts, guanine salts, 3,4-dihydroxyphenylalanine salts, alanine salts, aminobutyrate, 2-amino-2-methyl-1,3-propanediol salts, valine salts, proline salts, trishydroxyaminomethane salts, and lysine salts.

Particularly, carbonate, phosphates, tetraborates, and hydroxybenzoates are preferably employed since they are excellent in solubility and in buffering function at a high pH range greater than 9.0, and they do not adversely affect on photographic performance (for example, fog formation) whey they are added to the color developing solution, and they are available at low cost.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The present invention, however, should not be construed as being limited to these compounds.

The amount of the buffer to be added to the color developing solution is preferably 0.1 mol or more and more preferably from 0.1 mol to 0.4 mol per liter thereof.

In addition, various chelating agents can be used in the color developing solution according to the present invention for the purpose of preventing calcium or magnesium precipitation or increasing the stability of the color developing solution.

Specific examples of the chelating agents used are set forth below, but the present invention should not be construed as being limited thereto.

Nitrilotriacetic acid
Diethylenetriaminopentaacetic acid
Ethylenediaminetetraacetic acid
N,N,N-Trimethylenephosphonic acid
Ethylenediamine-N,N,N',N'-tetramethylenephosphonic acid
Trans-cyclohexanediaminetetraacetic acid
1,2-Diaminopropanetetraacetic acid
Glycol ether diaminetetraacetic acid
Ethylenediamine-o-hydroxyphenylacetic acid
2-Phosphonobutane-1,2,4-tricarboxylic acid 1-Hydroxyethane-1,1-diphosphonic acid
N,N'-Bis(2-hydroxybenzyl)ethylenediamine-N,N'-diacetic acid Two or more kinds of such chelating agents may be employed together, if desired.

The chelating agent is added to the color developing solution in an amount sufficient to block metal ions present therein. For example, a range of from about 0.1 g to about 10 g per liter of the color developing solution is employed.

The color developing solution may contain appropriate development accelerators, if desired. Typical example of the color development accelerator is benzyl alcohol. However, it is preferred that the color developing solution does not substantially contain benzyl alcohol, in order to keep simple the preparation of the solution and with regard to the prevention of environmental pollution. The terminology "color developing solution does not substantially contain benzyl alcohol" as used herein means that the color developing solution contains not more than 2 ml, and preferably no benzyl alcohol per liter of the solution.

Examples of suitable development accelerators include thioether type compounds as described in JP-B-37-16088, JP-B-37-5987, JP-B-38-7826, JP-B-44-12380, JP-B-45-9019 and U.S. Pat. No. 3,813,247; p-phenylenediamine type compounds as described in JP-A-52-49829 and JP-A-50-15554; quaternary ammonium salts as described in JP-A-50-137726, JP-B-44-30074, JP-A-56-156826 and JP-A-52-43429; amine type compounds as described in U.S. Pat. Nos. 2,494,903, 3,128,182, 4,230,796, 3,253,919, 2,482,546, 2,596,926, and 3,582,346 and JP-B-41-11431; polyalkylene oxides as described in JP-B-37-16088, JP-B-42-25201, U.S. Pat. No. 3,128,183, JP-B-41-11431, JP-B-42-23883 and U.S. Pat. No. 3,532,501; 1-phenyl-3-pyrazolidone and imidazoles.

The color developing solution used in the present invention may contain appropriate antifoggants, if desired. Alkali metal halides such as sodium chloride, potassium bromide, and potassium iodide as well as organic antifoggants may be employed as antifoggants. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

It is preferred that the color developing solution according to the present invention contains fluorescent brightening agents. As fluorescent brightening agents, 4,4'-diamino-2,2'-disulfostilbene type compounds are preferred. The amount of the fluorescent brightening agent added is less than 5 g and preferably from 0.1 g to 4 g per liter of the color developing solution.

Furthermore, the color developing solution according to the present invention may contain various surface active agents such as alkylsulfonic acids, arylsulfonic acids, aliphatic carboxylic acids, and aromatic carboxylic acids, if desired.

The processing temperature of the color development step used in the present invention is usually from 20° C. to 50° C. and preferably from 30° C. to 40° C. The processing time is usually from 20 sec. to 5 min. and preferably from 30 sec. to 2 min. Further, the amount of a replenisher used in the color developing solution is preferably as small as possible, and is usually from 20 ml to 600 ml, preferably from 50 ml to 300 ml, and more preferably from 60 ml to 200 ml, and most preferably from 60 ml to 150 ml per square meter of the color photographic light-sensitive material.

A silver removing step used in the present invention is described in detail below.

The silver removing step used in the present invention can be conducted using any general steps including a bleaching step-fixing step, fixing step-bleach-fixing step, bleaching step-bleach-fixing step, and bleach fixing step.

Now, bleaching solutions, bleach-fixing solutions and fixing solutions which can be employed in the present invention are described below.

Bleaching agents used in the bleaching solutions or the bleach-fixing solutions according to the present invention include any conventional bleaching agents. Particularly, organic complex salts of iron, cobalt, nickel, manganese and chromium, etc. Particularly, organic complex salts of iron (III), for example, complex salts of aminopolycarboxylic acids (e.g., ethylenediaminetetraacetic acid, or diethylenetriaminepentaacetic acid), aminopolyphosphonic acids, phosphonocarboxylic acids and organic phosphonic acids, or complex salts of organic acids (e.g., citric acid, tartaric acid, or malic acid), persulfates and hydrogen peroxide are preferably used. Of these compounds, organic acid complex salts of iron (III) are particularly preferred in view of a rapid processing and prevention of environmental pollution.

Specific examples of useful aminopolycarboxylic acids, aminopolyphosphonic acids and organic phosphonic acid suitable for forming organic complex salts of iron (III) are set forth below.

Ethylenediaminetetraacetic acid
Diethylenetriaminepentaacetic acid
1,3-Diaminopropanetetraacetic acid
Propylenediaminetetraacetic acid
Nitrilotriacetic acid
Cyclohexanediaminetetraacetic acid
Methyliminodiacetic acid
Iminodiacetic acid
Glycol ether diaminetetraacetic acid These compounds may be in the form of a salt such as sodium, potassium, lithium or ammonium salt.

Of these compounds, iron (III) complex salt of ethylenediaminetetraacetic acid, diethylenetriamine pentaacetic acid, cyclohexanediaminetetraacetic acid, 1,3-diaminopropanetetraacetic acid or methyliminodiacetic acid are preferred because of their high bleaching ability.

The ferric ion complex salts may be used in the form of a complex salt per se or may be formed in situ in solution by using a ferric salt (e.g., ferric sulfate, ferric chloride, ferric nitrate, ferric ammonium sulfate or ferric phosphate) and a chelating agent (e.g., an aminopolycarboxylic acid, an aminopolyphosphonic acid or a phosphonocarboxylic acid). Further, a chelating agent may be used in an excess amount of that being necessary for forming a ferric ion complex salt.

Of the ferric complex salts, aminopolycarboxylic acid ferric complex salts are preferred.

The amount of the ferric iron complex salt in the solution is from 0.01 mol to 1.0 mol, preferably from 0.05 mol to 0.50 mol per liter of the solution.

In the bleaching solution, bleach-fixing solution, and/or a prebath thereof as bleach accelerating agents, various kinds of compounds can be used. Specific examples of suitable bleach accelerating agents include compounds having a mercapto group or a disulfide bond as described, for example, in U.S. Pat. No. 3,893,858, West German Patent 1,290,812, JP-A-53-95630, *Research Disclosure*, No. 17129 (July, 1978); thiourea type compounds as described, for example, in JP-B-45-8506, JP-A-52-20832, JP-A-53-32735 and U.S. Pat. No. 3,706,561; and halides such as iodide ions, or bromide ions. These compounds are preferred in view of their large bleaching ability.

The bleaching solution or bleach-fixing solution used in the present invention can contain rehalogenating agents such as bromides (e.g., potassium bromide, sodium bromide, ammonium bromide), chlorides (e.g., potassium chloride, sodium chloride, or ammonium chloride) or iodides (e.g., ammonium iodide). Further, one or more kinds of inorganic acids, organic acids, alkali metal salts thereof or ammonium salts thereof which have a pH buffering ability (e.g., boric acid, sodium metaborate, acetic acid, sodium acetate, sodium carbonate, potassium carbonate, phosphorous acid, phosphoric acid, sodium phosphate, citric acid, sodium citrate, or tertaric acid), corrosion preventing agents (e.g., ammonium nitrate, or guanidine) may be added, if desired.

As fixing agents which can be employed in the bleaching solution or bleach-fixing solution according to the present invention, known fixing agents such as thiosulfates (e.g., sodium thiosulfate, or ammonium thiosulfate), thiocyanates (e.g., sodium thiocyanate, or ammonium thiocyanate), thioether compounds (e.g., such as ethylenebisthioglycolic acid, or 3,6-dithia 1,8-octanediol), and water-soluble silver halide dissolving agents (e.g., thioureas) are exemplified. They are employed individually or in a combination of two or more thereof. In addition, a special bleach-fixing solution comprising a combination of fixing agent and a large amount of a halide compound such as potassium iodide as described in JP-A-55-155354 can be used as well. In the present invention, a thiosulfate, particularly ammonium thiosulfate is preferably employed.

The amount of fixing agent to be used in the solution is preferably from 0.3 mol to 2 mol, and more preferably from 0.5 mol to 1.0 mol per liter of the solution.

The pH of the bleach-fixing solution or fixing solution used in the present invention is preferably from 3 to 10, and more preferably from 5 to 9.

Further, various-kinds of fluorescent brightening agent, defoaming agents and surface active agents, polyvinyl pyrrolidone, or organic solvents (e.g., methanol may be incorporated into the bleach-fixing solution.

The bleach-fixing solution or fixing solution used in the present invention can contain, as preservatives, compounds capable of releasing sulfite ions such as sulfites (e.g., sodium sulfite, potassium sulfite, or ammonium sulfite), bisulfites (e.g., ammonium bisulfite, sodium bisulfite, or potassium bisulfite), or metabisulfites (e.g., potassium metabisulfite, sodium metabisulfite, or ammonium metabisulfite). The amount of such a compound to be added is preferably from about 0.02 mol to about 0.50 mol, and more preferably from 0.04 mol to 0.40 mol per liter of the solution calculated in terms of a sulfite ion.

While it is general to add sulfites as preservatives, other compounds such as ascorbic acid, a carbonyl bisulfite acid adduct, or a carbonyl compound may be added.

Further, buffers, fluorescent brightening agent, chelating agents, deforming agents, or antimold agents may be added, if desired.

After a silver removing processing such as fixing or bleach-fixing, the silver halide color photographic material according to the present invention is generally subjected to a water washing step and/or a stabilizing step.

An amount of water required for the water washing step may be set in a wide range depending on characteristics of photographic light-sensitive materials (due to elements used therein, for example, couplers), uses thereof, temperature of washing water, the number of water washing tanks (stages}, the replenishment system such as countercurrent or orderly current, or other various conditions. A relationship between a number of water washing tanks and an amount of water in a multi stage countercurrent system can be determined based on the method as described in *Journal of the Society of Motion Picture and Television Engineers*, Vol. 64, pages 248 to 253 (May, 1955). Ordinarily, a number of stages used in the multi-stage countercurrent system is preferably from 2 to particularly from 2 to 4.

According to the multi-stage countercurrent system, the amount of water for washing can be significantly reduced, and the effects of the present invention because remarkable. For-example, it is possible to use 0.5 to 1 liter or less per $m^2$ of the photographic light-sensitive material. However, increase in staying time of water in a tank causes propagation of bacteria and some problems such as adhesion of floatage formed on the photographic materials occur. In the processing of the silver halide color photographic material according to the present invention, a method for reducing amounts of calcium and magnesium as described in Japanese Patent Application No. 61-131632 can be particularly effectively employed in order to solve such problems. Further, sterilizers, for example, isothiazolone compounds and cyabendazoles as : described in JP-A-57 8542, chlorine type sterilizers such as sodium chloroisocyanurate as described in JP-A-61-120145, benzotriazoles as described in Japanese Patent Application No. 60-105487, and copper ions, sterilizers as described in Hiroshi Horiguchi, *Bokin-Bobai No Kagaku* (Antibacterial and Antifungal Chemistry), *Biseibutsu No Mekkin-, Sakiin-, Bobai-Gijutsu* (Sterilizing and Antifungal Techniques of Microorganisms), edited by Eiseigijutsu Kai, or *Bokin-*Bobaizai Jiten (Handbook of Antibacterial and Antifungal Agents), edited by Nippon Bokin-Bobai Gakkai can be employed.

Moreover, surface active agents as agents for uniform drying, and chelating agents represented by EDTA as water softeners may be employed in washing water.

Following the above described water washing step, or directly without conducting the water washing step, the color photographic material can be treated with a stabilizing solution. To the stabilizing solution are added compounds having a function of stabilizing images, for example, aldehyde compounds represented by formalin, buffers for adjusting pH of layer to a value suitable for stabilization of dyes formed, or ammonium compounds. Further, various sterilizers or antimolds as described above can be employed in the stabilizing solution in order to prevent the propagation of bacteria in the solution and impart antimold property to the photographic material after processing. Moreover, surface active agents, fluorescent whitening agents, or hardener may be added to the stabilizing solution.

The photographic light-sensitive material of the present invention can be directly subjected to stabilizing processing without conducting the water washing step. In such a case, any of known methods as described, for example, in JP-A-57-8543, JP A-58-14834 and JP-A-60-220345 can be employed.

Further, a chelating agent such as 1-hydroxyethylidene-1,1-diphosphonic acid, or ethylenediaminetetramethylenephosphonic acid, a magnesium compound, or a bismuth compound may be preferably employed.

In the present invention, a so-called rinse solution may also be used as a water washing solution or stabilizing solution employed after the silver removing step.

The pH of washing water or stabilizing solution used in the processing of the photographic light-sensitive material according to the present invention is usually from 4 to 10 and preferably from 5 to 8. The temperature therefor can be set in a wide range depending on characteristics of photographic light-sensitive materials, or uses thereof. It is selected usually in a range from 15° C. to 45° C., preferably from 20° C. to 40° C. The processing time for the step can also be set appropriately, but it is desirable to set the time as short as possible in view of the reduction of processing time. Thus, it is preferably from 15 sec. to 1 min. 45 sec., more preferably from 30 sec. to 1 min. 30 sec.

It is preferred that the amount of replenishment is small in view of the reduction of running cost, the reduction of amount of discharge and associated handling properties.

The specific amount of replenishment is preferably from 0.5 to 50 times, more preferably from 3 to 40 times the amount of processing solution carried over from the preceding bath per a unit area of the photographic light-sensitive material. Alternatively, it is not more than 1 liter, preferably not more than 500 ml per $m^2$ of the photographic light-sensitive material. Further, the replenishment can be conducted either continuously or intermittently.

The solutions used in the water washing step and/or stabilizing step can be utilized in preceding steps. For instance, overflow from the washing water in a multistage countercurrent system is introduced into a bleach-fixing bath which is a preceding bath and a concentrated solution is supplied to the bleach fixing solution whereby an amount of discharge is reduced.

In the present invention, the total processing time of the silver removing step, water washing step and stabilizing step is not more than 2 min., preferably from 30 sec. to 1 min. 30 sec. The total time used herein means a period between time when the silver halide color photographic material is brought into contact with the first bath for the silver removing step and the time when it is discharged from the last bath for the water washing or stabilizing step, and includes time for transportation from one bath to another bath.

The terminology "the total processing time of the silver removing step, water washing step and stabilizing step is not more than 2 min." as used herein means that the sum of time for silver removing processing and processing before a drying step (more specifically, water washing and/or stabilizing) is not more than 2 min. Specifically, the sum of time for processing, for example, (1) silver removing→water washing, (2) silver removing→stabilizing, or (3) silver removing→water washing→stabilizing is not more than 2 min.

Using the coupler according to the present invention, a silver halide color photographic material which is excellent in color reproducibility, provides a high maximum color density with a high color forming rate while restraining fog to a very low level, particularly with a rapid processing can be obtained.

The present invention is explained in greater detail with reference to the following examples, but the present invention should not be construed as being limited thereto.

EXAMPLE 1

On a paper support, both surfaces of which were laminated with polyethylene, were coated layers as shown below in order to prepare a multilayer color printing paper which was designated Sample A. The coating solutions were prepared in the following manner.

Preparation of Coating Solution for First Layer 19.1 g of Yellow coupler (ExY), 4.4 g of Color image stabilizer (Cpd-1) and 0.7 g of Color image stabilizer (Cpd-7) were dissolved in a mixture of 27.2 ml of ethyl acetate and 8.2 ml of Solvent (Solv-3) and the resulting solution was emulsified and dispersed in 185 ml of a 10% aqueous solution of gelatin containing 8 ml of a 10% aqueous solution of sodium dodecylbenzenesulfonate. Separately, to a silver chlorobromide emulsion (cubic grains, grain size: 0.85 μm, coefficient of variation: 0.07, 1 mol% silver bromide based on the whole of grain being localized at a part of the surface of grain) were added $2.0\times10^{-4}$ mol of each of two blue-sensitive sensitizing dyes shown below per mol of silver and the emulsion was then subjected to sulfur sensitization. The above described emulsified dispersion was mixed with the silver chlorobromide emulsion, with the concentration of the resulting mixture being controlled, to form the composition shown below, whereby the coating solution for the first layer was prepared.

Coating solutions for the second layer to the seventh layer were prepared in a similar manner as described for the coating solution for the first layer.

1-Oxy-3,5-dichloro-s-triazine sodium salt was used as a gelatin hardener in each layer.

The following spectral sensitizing dyes were employed in the emulsion layers, respectively.

Blue-Sensitive Emulsion Layer:

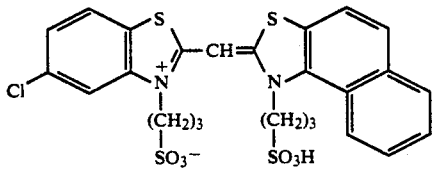

-continued

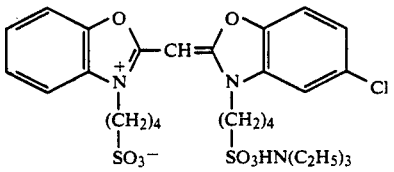

(Amount added: each $2.0 \times 10^{-4}$ mol per mol of silver halide)

Green-Sensitive Emulsion Layer:

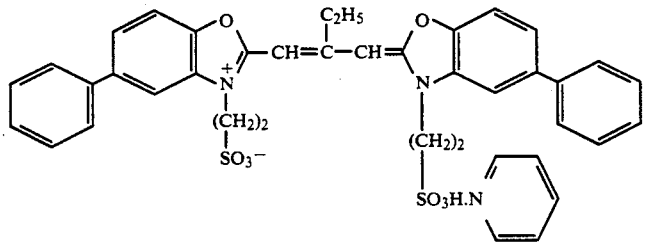

(Amount added: $4.0 \times 10^{-4}$ mol per mol of silver halide)

and

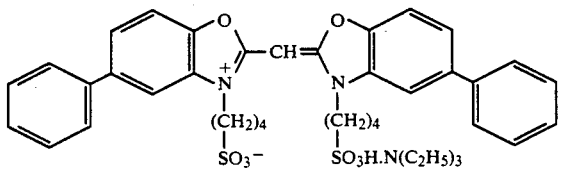

(Amount added: $7.0 \times 10^{-5}$ mol per mol of silver halide)

Red-Sensitive Emulsion Layer:

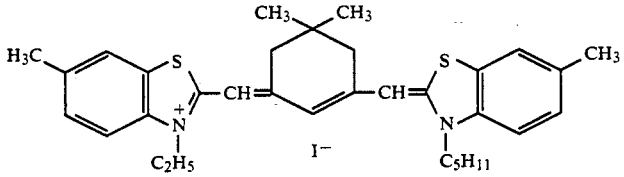

(Amount added: $0.9 \times 10^{-4}$ mol per mol of silver halide)

To the red-sensitive emulsion layer, was added the compound shown below in an amount of $2.6 \times 10^{-3}$ mol per mol of silver halide.

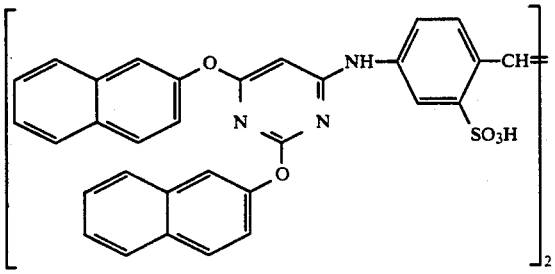

To the blue-sensitive emulsion layer, green-sensitive emulsion layer and red-sensitive emulsion layer, was added 1-(5-methylureidophenyl)-5-mercaptotetrazole in amounts of $8.5 \times 10^{-5}$ mol, $7.7 \times 10^{-4}$ mol and $2.5 \times 10^{-4}$ mol per mol of silver halide, respectively.

Moreover, in order to prevent irradiation, the following dyes were added to the emulsion layers.

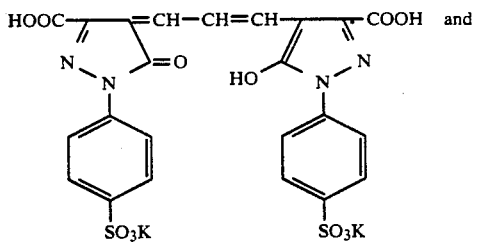

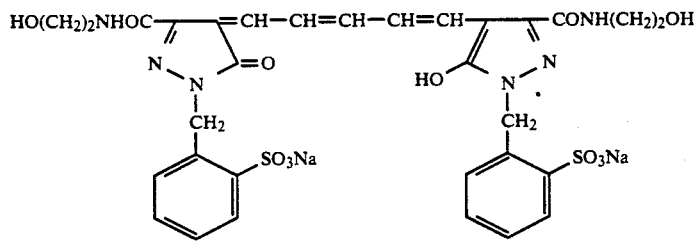

Layer Construction

The composition of each layer is shown below. The numerical value denotes the coating amounts of components in the units of g/m$^2$. The coating amount of silver halide emulsion is indicated in terms of silver coating amount.

| | | |
|---|---|---|
| Support | Polyethylene laminated paper (the polyethylene coating containing a white pigment ($TiO_2$) and a bluish dye (ultramarine) on the first layer side) | |
| First Layer (Blue-sensitive layer) | Silver chlorobromide emulsion described above | 0.30 |
| | Gelatin | 1.86 |
| | Yellow coupler (ExY) | 0.82 |
| | Color image stabilizer (Cpd-1) | 0.19 |
| | Color image stabilizer (Cpd-7) | 0.03 |
| | Solvent (Solv-1) | 0.35 |
| Second Layer (Color mixing preventing layer) | Gelatin | 0.99 |
| | Color mixing preventing agent (Cpd-5) | 0.08 |
| | Solvent (Solv-1) | 0.16 |
| | Solvent (Solv-4) | 0.08 |
| Third Layer (Green-sensitive layer) | Silver chlorobromide emulsion (cubic grains, grain size: 0.4 μm, coefficient of variation: 0.09, 1 mol % silver bromide based on the whole of grain being localized at a part of the surface of grain) | 0.20 |
| | Gelatin | 1.24 |
| | Magenta coupler (ExM) | 0.29 |
| | Color image stabilizer (Cpd-3) | 0.09 |
| | Color image stabilizer (Cpd-4) | 0.06 |

-continued

| | | |
|---|---|---|
| | Solvent (Solv-2) | 0.32 |
| | Solvent (Solv-7) | 0.16 |
| Fourth Layer (Ultraviolet light absorbing layer) | Gelatin | 1.58 |
| | Ultraviolet light absorbing agent (UV-1) | 0.47 |
| | Color mixing preventing agent (Cpd-5) | 0.05 |
| | Solvent (Solv-5) | 0.24 |
| Fifth Layer (Red-sensitive layer) | Silver chlorobromide emulsion (cubic grains, grain size: 0.36 μm, coefficient of variation: 0.11, 1.6 mol % silver bromide based on the whole of grain being localized at a part of the surface of grain) | 0.21 |
| | Gelatin | 1.34 |
| | Cyan coupler (ExC) | 0.34 |
| | Color image stabilizer (Cpd-6) | 0.17 |
| | Color image stabilizer (Cpd-7) | 0.34 |
| | Color image stabilizer (Cpd-9) | 0.04 |
| | Solvent (Solv-6) | 0.37 |
| Sixth Layer (Ultraviolet light absorbing layer) | Gelatin | 0.53 |
| | Ultraviolet light absorbing agent (UV-1) | 0.16 |
| | Color mixing preventing agent (Cpd-5) | 0.02 |
| | Solvent (Solv-5) | 0.08 |
| Seventh Layer (Protective layer) | Gelatin | 1.33 |
| | Acryl-modified polyvinyl alcohol copolymer (Degree of modification: 17%) | 0.17 |
| | Liquid paraffin | 0.03 |

The compounds used in the above-described layers have the chemical structures shown below respectively.

Yellow coupler (ExY)

-continued
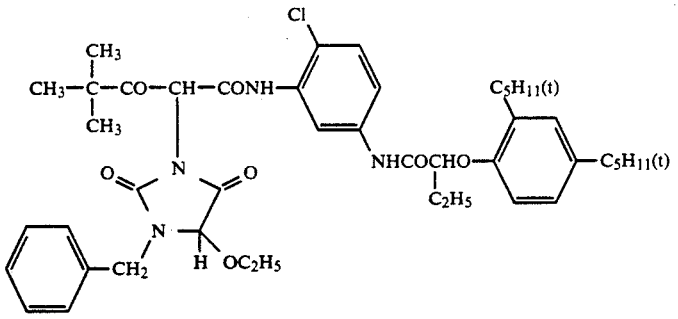
Magenta coupler (ExM)
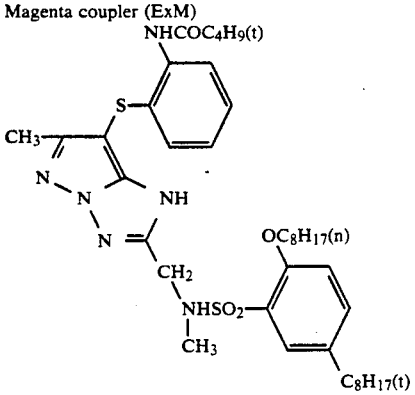
(Corresponding to Magenta Coupler M-1 according to the present invention)
Cyan coupler (ExC)
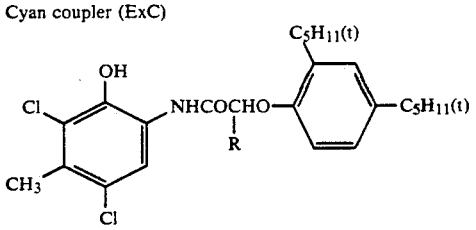
A mixture of R=H, $C_2H_5$ and $C_4H_9$ in a weight ratio of 1:3:6.
Color image stabilizer (Cpd-1)
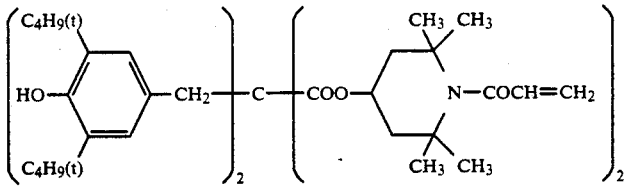
Color image stabilizer (Cpd-3)
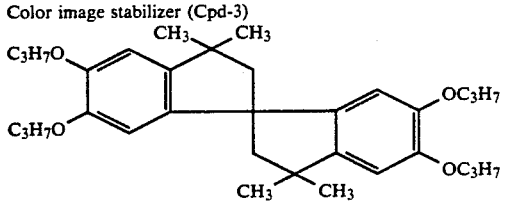
Color image stabilizer (Cpd-4)
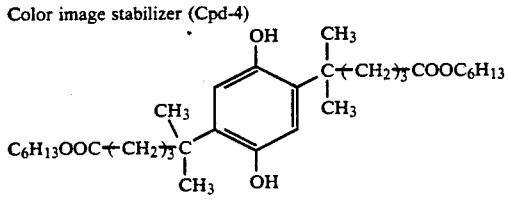
Color mixing preventing agent (Cpd-5)

-continued
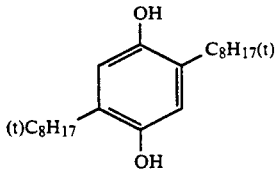
Color image stabilizer (Cpd-6)
A mixture of
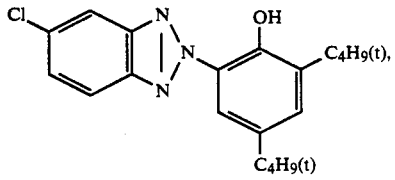
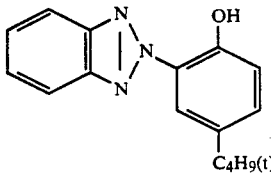
and
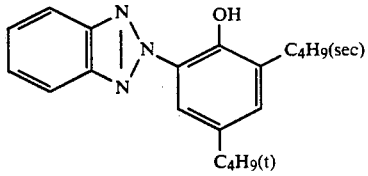
in a weight ratio of 2:4:4.
Color image stabilizer (Cpd-7)
$\leftarrow CH_2-\underset{\underset{CONHC_4H_9(t)}{|}}{CH}\rightarrow_n$
(average molocular weight: 60,000)
Color image stabilizer (Cpd-9)
A mixture of
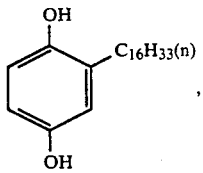
,
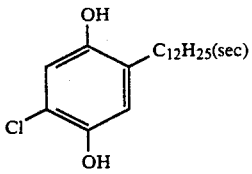
and
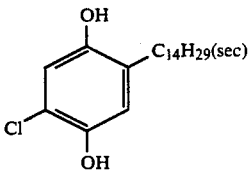
in a weight ratio of 1:1:1.
Ultraviolet light absorbing agent (UV-1)
A mixture of
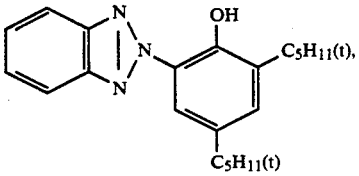
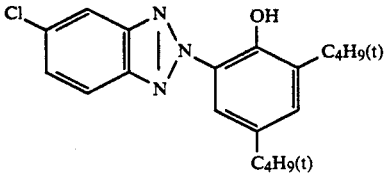
and -continued

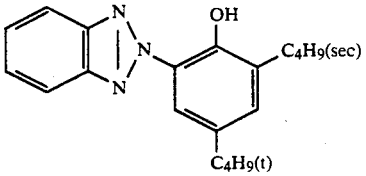

in a weight ratio 4:2:4.

Solvent (Solv-1)

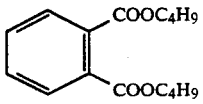

Solvent (Solv-2)
A mixture of

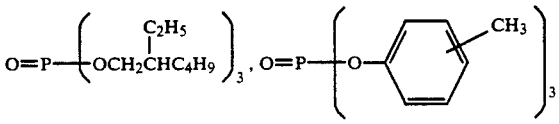

in a volume ratio of 3:7

Solvent (Solv-3)
$O{=}P{\leftarrow}O{-}C_9H_{19}{-}(iso))_3$

Solvent (Solv-4)

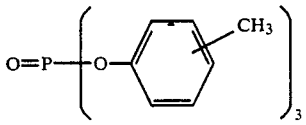

Solvent (Solv-5)

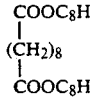

Solvent (Solv-6)

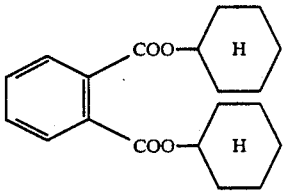

Solvent (Solv-7)

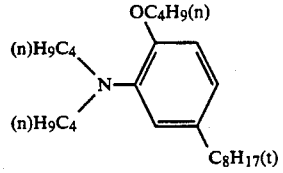

Samples B, C, D, E, F, G, H, I, J, K and L were prepared in the same manner as described for Sample A except for using the equimolar amount of Magenta Couplers M-4, M 7, M-14, M-18, M-20, M-23, M-27, M-30, M 31, M-33 and M-49 in place of Magenta Coupler M-1 and the mixture of tris(2-ethylhexyl)phosphate and tricresyl phosphate described above in twice the volume (ml) of the weight of the respective coupler.

Further, using Comparative Couplers (1) to (8) described above Samples M, N, O, P, Q, R, S and T were prepared in the same manner as described above, respectively.

Comparative Coupler (1):

-continued
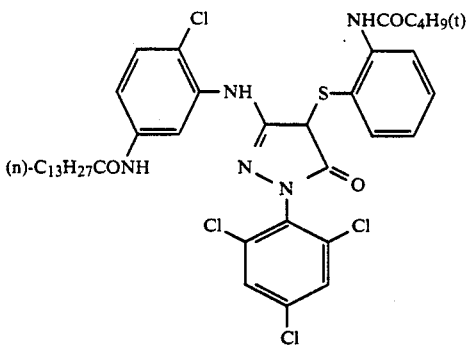
(compound (2) in U.S. Pat. No. 4,583,319)
Comparative Coupler (2):
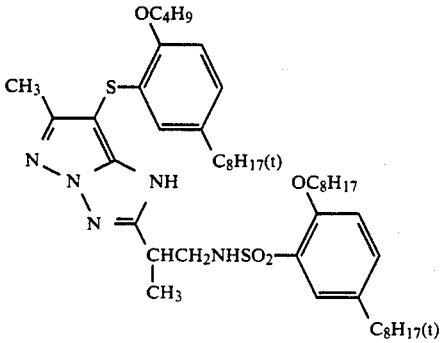
Comparative Coupler (3):
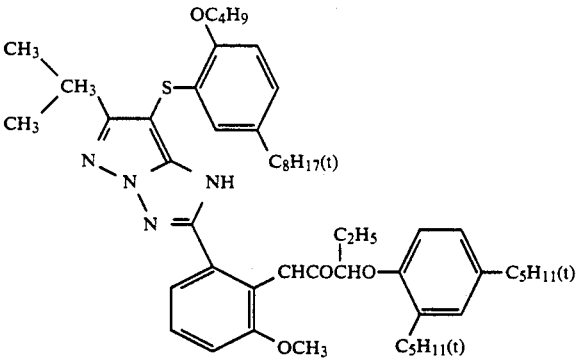
Comparative Coupler (4):
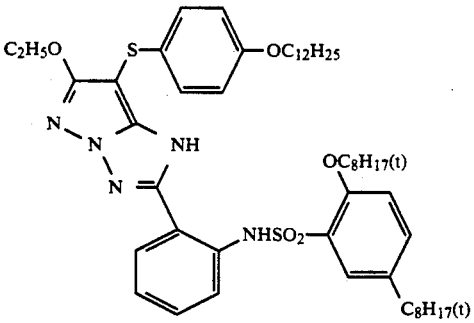
Comparative Coupler (5):

-continued

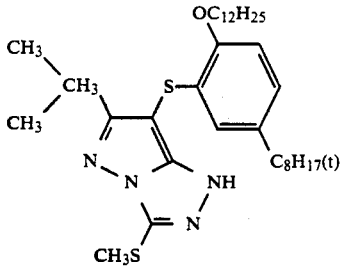

Comparative Coupler (6):

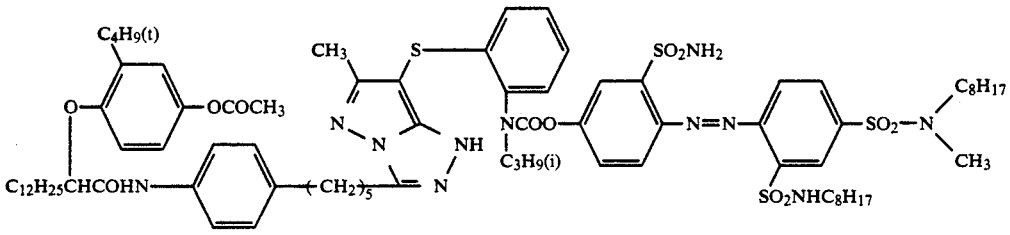

(M-6 in U.S. Pat. No. 4,842,985)

Comparative Coupler (7):

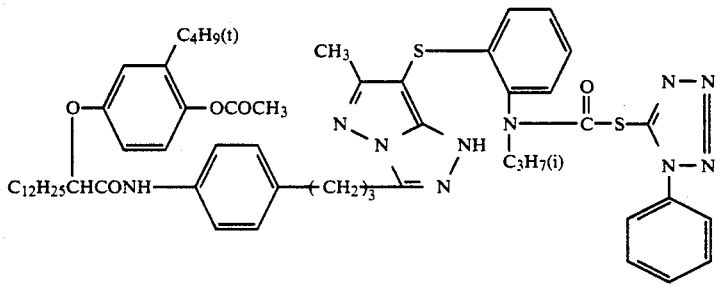

(D-II-3 in U.S. Pat. No. 4,801,520 and Coupler 44 in U.S. Pat. No. 4,248,962)

Comparative Coupler (8):

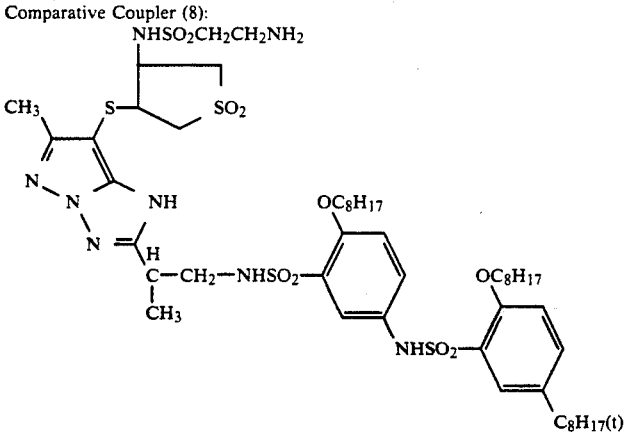

(Coupler (14) in U.S. Pat. No. 4,842,994)

Samples A to T thus prepared were exposed though an optical wedge and then subjected to the development processing according to the following processing steps.

| Processing Step | Temperature (°C.) | Time |
|---|---|---|
| Color Development | 35 | 45 sec. |
| Bleach-Fixing | 35 | 45 sec. |
| Washing with Water (1) | 35 | 30 sec. |
| Washing with Water (2) | 35 | 30 sec. |
| Washing with Water (3) | 35 | 30 sec. |

-continued

| Processing Step | Temperature (°C.) | Time |
|---|---|---|
| Drying | 75 | 60 sec. |

The composition of each processing solution used was as follows:

| Color Developing Solution: | |
|---|---|
| Water | 800 ml |

-continued

| | |
|---|---|
| Ethylenediamine N,N,N',N'-tetramethylenephosphonic acid | 3.0 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Bis(carboxymethyl)-hydrazine | 5.0 g |
| Fluorescent brightening agent (WHITEX 4B manufactured by Sumitomo Chemical Co., Ltd.) | 1.0 g |
| Water to make | 1000 ml |
| pH (25° C.) | 10.05 |
| Bleach-Fixing Solution: | |
| Water | 700 ml |
| Ammonium thiosulfate solution (700 g/l) | 100 ml |
| Ammonium sulfite | 18 g |
| Ammonium ethylenediaminetetraacetato ferrate dihydrate | 55 g |
| Disodium ethylenediaminetetraacetate | 3 g |
| Ammonium bromide | 40 g |
| Glacial acetic acid | 8 g |
| Water to make | 1000 ml |
| pH (25° C.) | 5.5 |

Water Washing Solution

City water was treated with an ion exchange resin so as to reduce the amount of calcium and magnesium to not more than 3 ppm, respectively. The dielectric constant of the water was 5 μs/cm at 25° C.

The evaluation of photographic properties with the samples were conducted by three factors of relative sensitivity, maximum density (Dmax) and fog density. The relative sensitivity is a relative value when the sensitivity of Sample A is taken as 100 and the sensitivity is shown by a reciprocal of the exposure amount required for obtaining a density of the minimum density plus 0.5.

The results obtained are shown in Table 1 below.

TABLE 1

| Sample | Relative Sensitivity | G. Dmax | $Fog^D$ | Remark |
|---|---|---|---|---|
| A | 100 | 2.20 | 0.08 | Present Invention |
| B | 112 | 2.28 | 0.10 | " |
| C | 110 | 2.24 | 0.10 | " |
| D | 127 | 2.10 | 0.10 | " |
| E | 120 | 2.22 | 0.09 | " |
| F | 125 | 2.32 | 0.10 | " |
| G | 128 | 2.25 | 0.11 | " |
| H | 130 | 2.33 | 0.11 | " |
| I | 132 | 2.36 | 0.11 | " |
| J | 128 | 2.34 | 0.11 | " |
| K | 128 | 2.33 | 0.11 | " |
| L | 80 | 1.90 | 0.10 | " |
| M | 128 | 2.34 | 0.18 | Comparison |
| N | 73 | 1.88 | 0.12 | " |
| O | 108 | 2.20 | 0.13 | " |
| P | 123 | 2.08 | 0.14 | " |
| Q | 70 | 1.85 | 0.11 | " |
| R | 72 | 1.78 | 0.16 | Comparison |
| S | 66 | 1.42 | 0.10 | " |
| T | 93 | 1.85 | 0.14 | " |

Pyrazoloazole types magenta coupler used for Sample M disclosed in U.S. Pat. No. 4,853,319, provides marked fog, although the magenta coulper has the same releasing group as that of the present invention. But, nevertheless it provides remarkably superior results in fog, when changing a mother nuclear thereof, as is apparent from the coupler of the present invention. It is unexpectedly surprising matter for the skilled one in the art.

As is seen in Samples N to T, pyrazoloazole type magenta coupler having a releasing group, which is without the claimed groups, also does not provide sufficient results in terms of relative sensitivity, Dmax and fog. Especially, comparative magenta coupler used for Sample R (U.S. Pat. No. 4,842,985) and comparative magenta coupler used for Sample S (U.S. Pat. Nos. 4,801,520 and 4,248,962), which are both different from the present invention in a definition of $R_2$ in the general formula (I), also do not provide sufficient results in terms of relative sensitivity, Dmax and fog.

Comparative magenta coupler used for Sample T (U.S. Pat. No. 4,842,994) is different from the magenta coupler of the present invention in view of a releasing group of formula (I), having no double bond, and thus is inferior to the coupler of the present invention of Dmax, relative sensitivity and fog.

From the results shown in Table 1 above, it is apparent that the couplers according to the present invention exhibit high sensitivity and high Dmax without the undesirable fog formation in a rapid processing in comparison with other pyrazoloazole type couplers having an arylthio releasing group illustrated as the comparative couplers. Thus, it can be seen that the couplers according to the present invention are unexpectedly excellent couplers.

Further, the pyrazoloazole type couplers according to the present invention do not provide for undesirable subsidiary absorption.

EXAMPLE 2

On a paper support, both surfaces of which were laminated with polyethylene, were coated layers as shown below in order to prepare a multilayer color printing paper which was designated Sample A'. The coating solutions were prepared in the following manner.

Preparation of Coating Solution for First Layer 19.1 g of Yellow coupler (ExY), 4.4 g of Color image stabilizer (Cpd-1) and 1.8 g of Color image stabilizer (Cpd-7) were dissolved in a mixture of 27.2 ml of ethyl acetate and 4.1 g of Solvents (Solv-3) and (Solv 6) and the resulting solution was emulsified and dispersed in 185 ml of a 10% aqueous solution of gelatin containing 8 ml of a 10% aqueous solution of sodium dodecylbenzenesulfonate. Separately, a silver chlorobromide emulsion [mixture of a silver chlorobromide emulsion (silver bromide content: 80.0 mol%, cubic grain, average grain size: 0.85 mμ, coefficient of variation: 0.08) and a silver chlorobromide emulsion (silver bromide content: 80.0 mol%, cubic grain, average grain size: 0.62 μm, coefficient of variation: 0.07) in a silver molar ratio of 1:3]was subjected to sulfur sensitization and thereto was added $5.0\times10^{-4}$ mol of a blue-sensitive sensitizing dye shown below per mol of silver to prepare a blue-sensitive emulsion. The above described emulsified dispersion was mixed with the blue-sensitive silver halide emulsion with the concentration of the resulting mixture being controlled to form the composition shown below, whereby the coating solution for the first layer was prepared.

Coating solutions for the second layer to the seventh layer were prepared in a similar manner as described for the coating solution for the first layer.

1-Oxy-3,5-dichloro-s-triazine sodium salt was used as a gelatin hardener in each layer.

The following spectral sensitizing dyes were employed in the emulsion layers, respectively.

Blue-Sensitive Emulsion Layer:

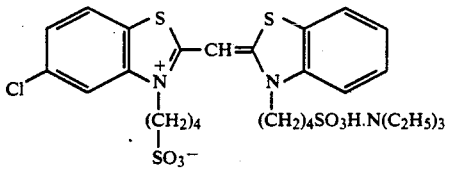

(Amount added: $5.0 \times 10^{-4}$ mol per mol of silver halide)

Green-Sensitive Emulsion Layer:

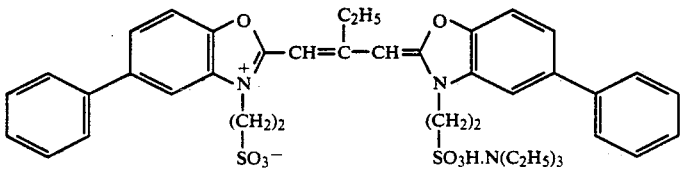

(Amount added: $4.0 \times 10^{-4}$ mol per mol of silver halide)

and

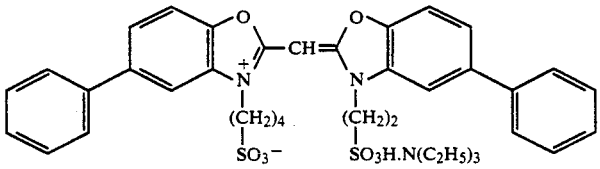

(Amount added: $7.0 \times 10^{-5}$ mol per mol of silver halide)

Red-Sensitive Emulsion Layer:

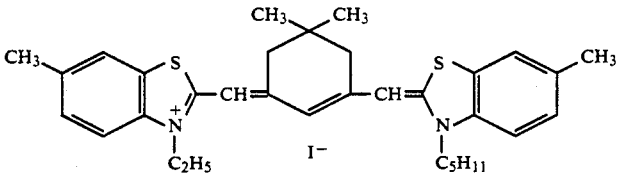

(Amount added: $0.9 \times 10^{-4}$ mol per mol of silver halide)

To the red-sensitive emulsion layer was added the compound described below in an amount of $2.6 \times 10^{-3}$ mol per mol of silver halide.

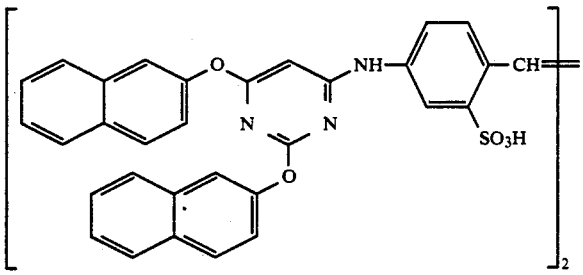

Further, to the blue-sensitive emulsion layer, green-sensitive emulsion layer and red-sensitive emulsion layer, were added 1-(5-methylureidophenyl)-5-mercaptotetrazole in amounts of $4.0 \times 10^{-6}$ mol, $3.0 \times 10^{-5}$ mol and $1.0 \times 10^{-5}$ mol per mol of silver halide, respectively, and 2-methyl-5-tert-octylhydroquinone in amounts of $8 \times 10^{-3}$ mol, $2 \times 10^{-2}$ mol and $2 \times 10^{-2}$ mol per mol of silver halide, respectively.

Moreover, to the blue-sensitive emulsion layer and green-sensitive emulsion layer, was added 4-hydroxy-6-methyl-1,3,3a,7-tetraazaindene in amounts of $1.2 \times 10^{-2}$ mol and $1.1 \times 10^{-2}$ mol per mol of silver halide, respectively.

Furthermore, in order to prevent irradiation, the following dyes were added to the emulsion layers.

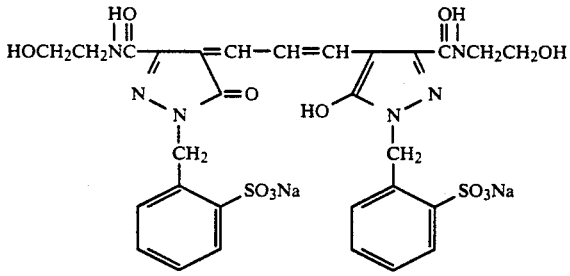

and

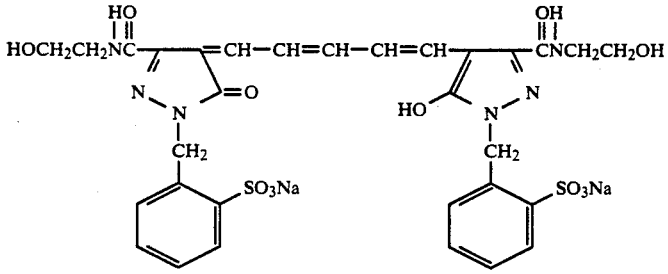

Layer Construction

The composition of each layer is shown below. The numerical values denote the coating amounts of components in the units of g/m$^2$. The coating amount of silver halide emulsion is indicated in terms of silver coating amount.

| | | |
|---|---|---|
| Support | Polyethylene laminated paper (the polyethylene coating containing a white pigment ($TiO_2$) and a bluish dye (ultramarine) on the first layer side) | |
| First Layer (Blue-sensitive layer) | Silver chlorobromide emulsions described above (silver bromide: 80 mol %) | 0.26 |
| | Gelatin | 1.83 |
| | Yellow coupler (ExY) | 0.83 |
| | Color Image Stabilizer (Cpd-1) | 0.19 |
| | Color Image Stabilizer (Cpd-7) | 0.08 |
| | Solvent (Solv-3) | 0.18 |
| | Solvent (Solv-6) | 0.18 |
| Second Layer (Color mixing preventing layer) | Gelatin | 0.99 |
| | Color mixing preventing agent (Cpd-6) | 0.08 |
| | Solvent (Solv-1) | 0.16 |
| | Solvent (Solv-4) | 0.08 |
| Third Layer (Green-sensitive layer) | Silver chlorobromide emulsions (mixing of a silver chlorobromide emulsion (silver bromide content: 90 mol %, cubic grain, average grain size: 0.47 μm, coefficient of variation: 0.12) and a silver chlorobromide emulsion (silver bromide content: 90 mol %, cubic grain, average grain size: 0.36 μm, coefficient of variation: 0.09) in a silver molar ratio of 1:1) | 0.16 |
| | Gelatin | 1.79 |
| | Magenta coupler (ExM) | 0.32 |
| | Color image stabilizer (Cpd-3) | 0.20 |
| | Color image stabilizer (Cpd-8) | 0.03 |

-continued

| | | |
|---|---|---|
| | Color image stabilizer (Cpd-4) | 0.01 |
| | Color image stabilizer (Cpd-9) | 0.04 |
| | Solvent (Solv-2) | 0.65 |
| Fourth Layer (Ultraviolet light absorbing layer) | Gelatin | 1.58 |
| | Ultraviolet light absorbing agent (UV-1) | 0.47 |
| | Color mixing preventing agent (Cpd-5) | 0.05 |
| | Solvent (Solv-5) | 0.24 |
| Fifth Layer (Red-sensitive layer) | Silver chlorobromide emulsions (mixing of a silver chlorobromide emulsion (silver bromide content: 70 mol %, cubic grain, average grain size: 0.49 μm, coefficient of variation: 0.08) and a silver chlorobromide emulsion (silver bromide content: 70 mol %, cubic grain, average grain size: 0.34 μm, coefficient of variation: 0.10) in a silver molar ratio of 1:2) | 0.23 |
| | Gelatin | 1.34 |
| | Cyan coupler (ExC) | 0.30 |
| | Color image stabilizer (Cpd-6) | 0.17 |
| | Color image stabilizer (Cpd-7) | 0.40 |
| | Solvent (Solv-6) | 0.20 |
| Sixth Layer (Ultraviolet light absorbing layer) | Gelatin | 0.53 |
| | Ultraviolet light absorbing agent (UV-1) | 0.16 |
| | Color mixing preventing agent (Cpd-5) | 0.02 |
| | Solvent (Solv-5) | 0.08 |
| Seventh Layer (Protective layer) | Gelatin | 1.33 |
| | Acryl-modified polyvinyl alcohol copolymer (Degree of modification: 17%) | 0.17 |
| | Liquid paraffin | 0.03 |

The compounds used in the above-described layers have the chemical structures shown below, respectively.

Yellow Coupler (ExY)

-continued
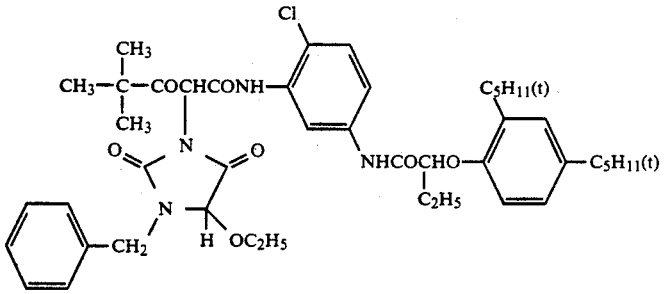
Magenta coupler (ExM)
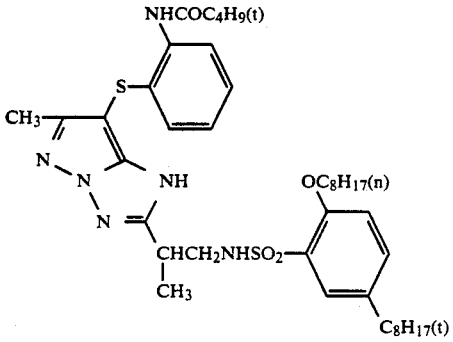
Cyan Coupler (ExC-C)
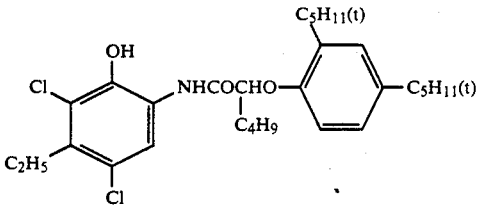
and
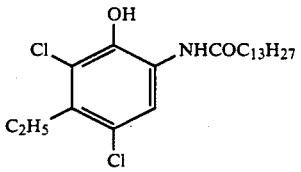
in a molar ratio of 1:1
Color image stabilizer (Cpd-1)
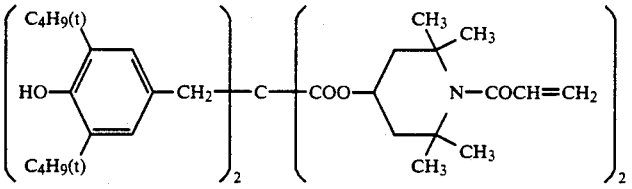
Color image stabilizer (Cpd-3)
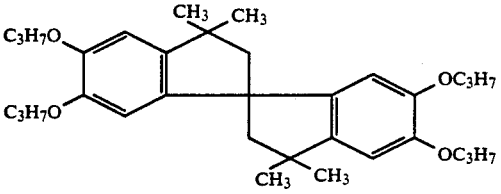
Color image stabilizer (Cpd-4)
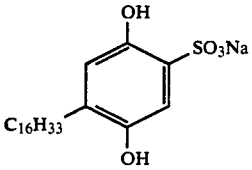
Color mixing preventing agent (Cpd-5)

-continued
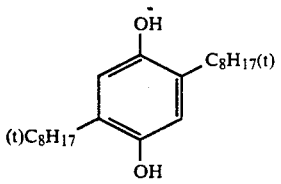
Color image stabilizer (Cpd-6)
A mixture of
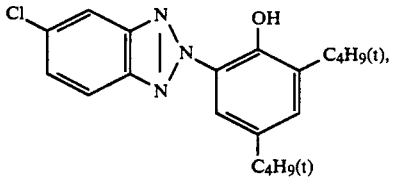
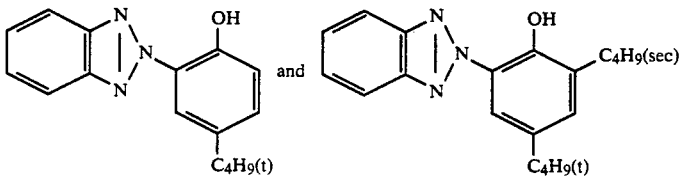
in a weight ratio of 2:4:4.
Color image stabilizer (Cpd-7)
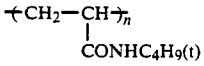
(average molecular weight: 80,000)
Color image stabilizer (Cpd-8)
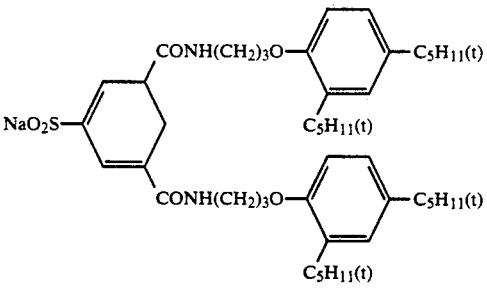
Color image stabilizer (Cpd-9)
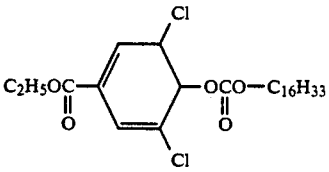
Ultraviolet light absorbing agent (UV-1)
A mixture of
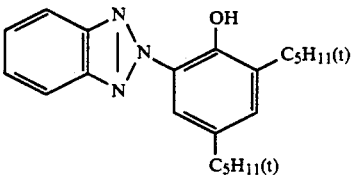

-continued

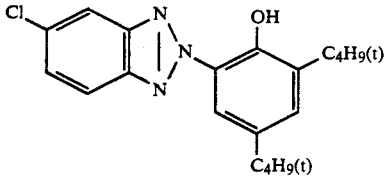

and

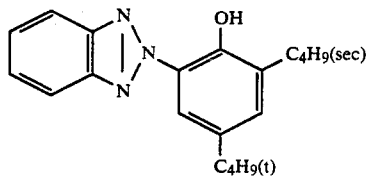

in a weight ratio of 4:2:4.

Solvent (Solv-1)

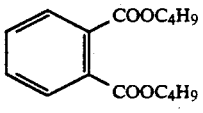

Solvent (Solv-2)
A mixture of

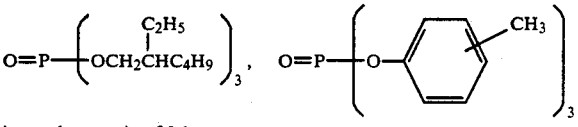

in a volume ratio of 2:1

Solvent (Solv-3)
$O{=}P{-}(O{-}C_9H_{19}\text{-(iso)})_3$

Solvent (Solv-4)

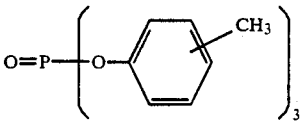

Solvent (Solv-5)

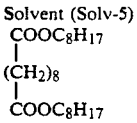

Solvent (Solv-6)

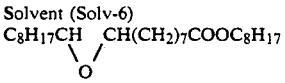

Using the couplers according to the present invention and the comparative couplers used in Example 1, Samples B' to Q' were prepared in the same manner as described for Sample A'.

Samples A' to Q' thus prepared were exposed to light through an optical wedge and then subjected to the development processing according to the following processing steps.

| Processing Step | Temperature (°C.) | Time |
|---|---|---|
| Color Development | 35 | 45 sec. |
| Bleach-Fixing | 30 to 36 | 45 sec. |
| Stabilizing (1) | 30 to 37 | 20 sec. |
| Stabilizing (2) | 30 to 37 | 20 sec. |
| Stabilizing (3) | 30 to 37 | 20 sec. |
| Stabilizing (4) | 30 to 37 | 30 sec. |
| Drying | 70 to 85 | 60 sec. |

The stabilizing steps were conducted using a four-tank countercurrent system from Stabilizing (4) to Stabilizing (1).

The composition of each processing solution used was as follows:

| | |
|---|---|
| Color Developing Solution: | |
| Water | 800 ml |
| Ethylenediaminetetraacetic acid | 2.0 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 4.2 g |
| 5,6-Dihydroxybenzene-1,2,4-trisulfonic acid | 0.3 g |
| Brightening agent (4,4'-diaminostilbene type) | 2.0 g |
| Water to make | 1000 ml |
| pH (25° C.) | 10.10 |
| Bleach-Fixing Solution: | |
| Water | 400 ml |
| Ammonium thiosulfate (70%) | 100 ml |
| Sodium sulfite | 18 g |
| Ammonium ethylenediaminetetraacetato ferrate | 55 g |
| Disodium ethylenediamine-tetraacetate | 3 g |
| Glacial acetic acid | 8 g |
| Water to make | 1000 ml |
| pH (25° C.) | 5.5 |
| Stabilizing Solution | |
| Formaldehyde (37%) | 0.1 g |

-continued

| | |
|---|---|
| Formaldehyde-sulfite adduct | 0.7 g |
| 5-Chloro-2-methyl-4-isothiazolin-3-one | 0.02 g |
| 2-Methyl-4-isothiazolin-3-one | 0.01 g |
| Cupric sulfate | 0.005 g |
| Water to make | 1000 ml |
| pH (25° C.) | 4.0 |

The relative sensitivity, Dmax and Fog thus obtained had a similar trend to those shown in Table 1 of Example 1. Thus, the couplers according to the present invention are excellent with respect to conventional processing in comparison with the comparative couplers tested.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer and at least one pyrazoloazole type color image forming coupler having a releasing group represented by the general formula (I'), at a coupling active position:

(I')

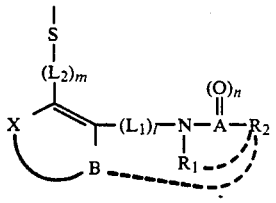

wherein $L_1$ and $L_2$ each represents a methylene group or an ethylene group; l and m each represents 0 to 1; $R_1$ represents a hydrogen atom, an alkyl group, an aryl group or a heterocyclic group; $R_2$ represents an alkyl group, an aryl group, or an alkylamino group; A represents a carbon atom or a sulfur atom; n represents 1, when A is a carbon atom, or 1 or 2, when A is a sulfur atom; B represents a carbon atom, an oxygen atom, a nitrogen atom or a sulfur atom; X represents an atomic group necessary to form a ring; $R_1$ and $R_2$ may connect with each other to form a ring; and B and $R_2$ may connect with each other to form a ring, when B is a carbon atom or a nitrogen atom.

2. A silver halide photographic material as claimed in claim 1, wherein the pyrazoloazole type color image forming coupler has a coupler residue linking to the releasing group represented by the general formula (I') which residue is represented by the following general formula (II):

(II)

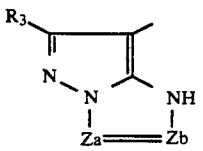

wherein $R_3$ represents a hydrogen atom or a substituent; Za and Zb each represents

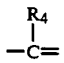

or —N=; and $R_4$ represents a hydrogen atom or a substituent.

3. A silver halide photographic material as claimed in claim 2, wherein the substituent represented by $R_3$ or $R_4$ is a straight chain, branched chain or cyclic, substituted or unsubstituted alkyl group having from 1 to 30 carbon atoms, an aryl group, a heterocyclic group, an alkoxy group, a heterocyclic oxy group, an amino group, an anilino group, an amido group, a urethane group, a ureido group, a sulfonamido group, an alkylthio group, an arylthio group, a sulfinyl group, a sulfonyl group, a sulfo group, a cyano group, or a nitro group.

4. A silver halide photographic material as claimed in claim 2, wherein the substituent represented by $R_3$ or $R_4$ is a heterocyclic amino group.

5. A silver halide photographic material as claimed in claim 2, wherein the pyrazoloazole type color image forming coupler residue is a residue represented by the following general formula (III) or (IV):

(III)

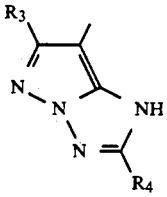

(IV)

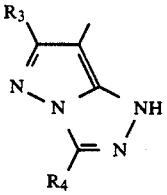

wherein $R_3$ and $R_4$ each has the same meaning as defined in the general formula (II).

6. A silver halide photographic material as claimed in claim 4, wherein $R_3$ and $R_4$ each represents an alkyl group, an aryl group, an alkoxy group, or an aryloxy group.

7. A silver halide photographic material as claimed in claim 4, wherein $R_3$ represents an alkoxy group or an aryloxy group in the general formula (III).

8. A silver halide photographic material as claimed in claim 1, wherein a substituent for the methylene group or ethylene group represented by $L_1$ or $L_2$ is selected from a halogen atom, an aliphatic group, an aryl group, a heterocyclic group, an alkoxy group, an aryloxy group, an alkylamino group, an alkoxycarbonyl group, a carbamoyl group, an anilino group, a sulfamoyl group, an alkylsulfonyl group, an arylsulfonyl group, an alkylthio group, an arylthio group, an acyl group, an acylamino group, an imido group, a ureido group, a sulfamoylamino group, an alkoxycarbonylamino group, a sulfonamido group, a hydroxy group and a cyano group.

9. A silver halide photographic material as claimed in claim 1, wherein $R_2$ represents an alkyl group.

10. A silver halide photographic material as claimed in claim 1, wherein X represents an atomic group composed of atoms selected from a carbon atom, an oxygen atom, a nitrogen atom and a sulfur atom necessary to form a saturated or unsaturated 5 membered, 6-membered or 7-membered ring.

11. A silver halide photographic material as claimed in claim 1, wherein the ring formed with $R_1$ and $R_2$ is a saturated or unsaturated 5-membered or 6-membered ring.

12. A silver halide photographic material as claimed in claim 1, wherein the ring formed with B and $R_2$ is a saturated or unsaturated 5-membered or 6-membered ring.

13. A silver halide photographic material as claimed in claim 2, wherein the coupler is represented by the following general formula (V):

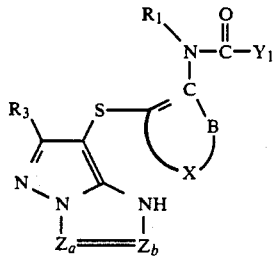

(V)

wherein $Y_1$ represents Ra or $Z_1$—Rb; Ra represents a substituted or unsubstituted aryl group, or a substituent having a secondary or tertiary group represented by

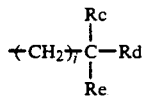

i represents 0 or 1; $Z_1$ represents NRf; Rb represents a substituted or unsubstituted alkyl group; Rc and Rd each represents a halogen atom or a group selected from those defined for Rb and $Z_2$—Rg; Re represents a hydrogen atom or a group selected from those defined for Rc and Rd; Rf represents a hydrogen atom; $Z_2$ represents an oxygen atom; Rg represents a substituted or unsubstituted alkyl group or a substituted or unsubstituted aryl group; Rc may connect with at least one of Rd and Re to form one or two carboxylic rings or tetracyclic rings which may further have one or more substituents; $R_1$ represents a hydrogen atom, an alkyl group, an aryl group or a heterocyclic group; X represents an atomic group necessary to form a ring; B represents a carbon atom, an oxygen atom, a nitrogen atom or a sulfur atom; and $R_3$, Za and Zb each has the same meaning as defined in claim 2.

14. A silver halide photographic material as claimed in claim 13, wherein the coupler is represented by the following general formula (VI):

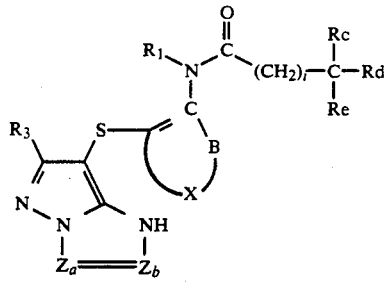

(VI)

wherein $R_3$ represents a hydrogen atom or a substituent; Za and Zb each represents —C($R_4$)= or —N=; $R_4$ represents a hydrogen atom or a substituent; Rc, Rd, Re, X and B each has the same meaning as recited in claim 13; and i represents 0 or 1.

15. A silver halide photographic material as claimed in claim 2, wherein the coupler is represented by the following general formula (VII):

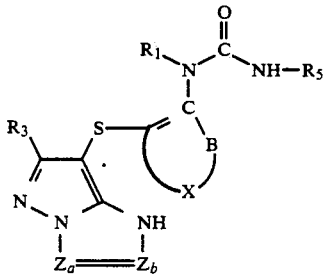

(VII)

wherein $R_5$ represents a substituted or unsubstituted alkyl group; $R_1$ represents a hydrogen atom, an alkyl group, an aryl group or a heterocyclic group; X represents an atomic group necessary to form a ring; B represents a carbon atom, an oxygen atom, a nitrogen atom or a sulfur atom; and $R_3$, Za and Zb are as recited in claim 2.

16. A silver halide photographic material as claimed in claim 2, wherein the coupler is represented by the following general formula (VIII):

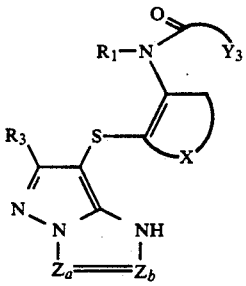

(VIII)

wherein $R_1$, $R_3$, Za, Zb, and X each has the same meaning as in claim 2, $Y_3$ represents a substituted or unsubstituted methylene or ethylene group.

17. A silver halide photographic material as claimed in claim 2, wherein the coupler is represented by the following general formula (IX):

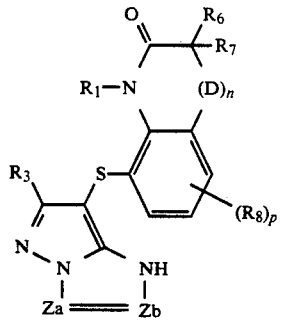

(IX)

wherein $R_1$, $R_3$, Za and Zb each has the same meaning as defined in claim 2, $R_6$ and $R_7$ each represents an alkyl group or an aryl group; $R_8$ represents a substituent selected from those defined for $L_1$ or $L_2$; D represents a methylene group, an oxygen atom, a nitrogen atom or a sulfur atom; n represents an integer from 0 to 3, when D represents a methylene group, or 1, when D represents an oxygen atom, a nitrogen atom or a sulfur atom; and P represents an integer from 0 to 3.

18. A silver halide photographic material as claimed in claim 1, wherein the coupler is a copolymer of a monomer containing a coupler moiety derived from the coupler represented by the general formula (I') and a non-color forming ethylenic monomer.

19. A silver halide photographic material as claimed in claim 1, wherein the coupler is dispersed together with at least one organic solvent having a high boiling point to be incorporated into the silver halide emulsion layer.

20. A silver halide photographic material as claimed in claim 19, wherein the organic solvent having a high boiling point is represented by the following general formulae (A), (B), (C), (D) or (E):

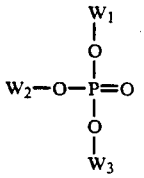

(A)

$W_1$—COO—$W_2$ (B)

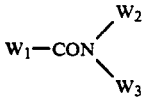

(C)

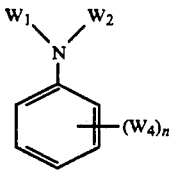

(D)

$W_1$—O—$W_2$ (E)

wherein $W_1$, $W_2$ and $W_3$ each represents a substituted or unsubstituted alkyl group, a substituted or unsubstituted alkenyl group, a substituted or unsubstituted aryl group or a substituted or unsubstituted heterocyclic group; $W_4$ represents $W_1$, —O—$W_1$ or —S—$W_1$; n represents an integer from 1 to 5, and when n is two or more, two or more $W_4$'s may be the same or different; $W_1$ and $W_2$ in the general formula (E) may combine with each other to form a condensed ring.

21. A silver halide photographic material as recited in claim 20, wherein $W_1$, $W_2$ and $W_3$ each represent a substituted or unsubstituted alkyl group which is a substituted or unsubstituted cycloalkyl group.

22. A silver halide photographic material as claimed in claim 1, wherein the silver halide emulsion layer further contains a compound (F) which is capable of forming a chemical bond with the aromatic amine developing agent remaining after color development to give a chemically inactive and substantially colorless compound.

23. A silver halide photographic material as claimed in claim 22, wherein the compound (F) is represented by the following general formula (FI) or (FII):

$R_1$—$(A)_n$—X (FI)

$R_1$—$(A)_n$—X (FI)

$R_2$—C(B)=Y (FII)

wherein $R_1$ and $R_2$ each represents an aliphatic group, an aromatic group or a heterocyclic group; X represents a group to be released by a reaction with an aromatic amine developing agent; A represents a group capable of forming a chemical bond by a reaction with an aromatic amine developing agent; n represents 0 or 1; B represents a hydrogen atom, an aliphatic group, an aromatic group, a heterocyclic group, an acyl group or a sulfonyl group; Y represents a group capable of accelerating the addition of an aromatic amine developing agent to the compound represented by the general formula (FII); and $R_1$ and X, or Y and $R_2$ or B may combine with each other to form a cyclic structure.

24. A silver halide photographic material as claimed in claim 1, wherein the silver halide emulsion layer further contains a compound (G) which is capable of forming a chemical bond with the oxidation product of the aromatic amine developing agent remaining after color development to give a chemically inactive and substantially colorless compound.

25. A silver halide photographic material as claimed in claim 24, wherein the silver halide emulsion layer contains a compound (F) in addition to the compound (G); wherein the compound (F) is represented by the following general formula (FI) or (FII):

$R_1$—$(A)_n$—X (FI)

$R_1$—$(A)_n$—X (FI)

$R_2$—C(B)=Y (FII)

wherein $R_1$ and $R_2$ each represents an aliphatic group, an aromatic group or a heterocyclic group; X represents a group to be released by a reaction with an aromatic amine developing agent; A represents a group capable of forming a chemical bond by a reaction with an aromatic amine developing agent; n represents 0 or 1; B represents a hydrogen atom, an aliphatic group, an aromatic group, a heterocyclic group, an acyl group or a sulfonyl group; Y represents a group capable of accelerating the addition of an aromatic amine developing agent to the compound represented by the general formula (FII); and $R_1$ and X, or Y and $R_2$ or B may combine with each other to form a cyclic structure.

26. A silver halide photographic material as claimed in claim 24, wherein the compound (G) is represented by the following general formula (GI):

$$R—Z \qquad \text{(GI)}$$

wherein R represents an aliphatic group or an aromatic group or a heterocyclic ring; Z represents a nucleophilic group or a group capable of releasing a nucleophilic group by a decomposition in a photographic material.

27. A silver halide photographic material as claimed in claim 1, wherein l and m each represents 0.

28. A silver halide photographic material as claimed in claim 1, wherein A represents a carbon atom and n represents 1.

29. A silver halide photographic material as claimed in claim 1, wherein $R_1$ represents a hydrogen atom.

30. A silver halide photographic material as claimed in claim 2, wherein the coupler is represented by the following general Formula (III):

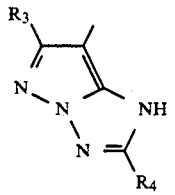

(III)

wherein $R_3$ and $R_4$ are as defined in claim 2.

31. A silver halide photographic material as claimed in claim 30, wherein:

$R_3$ and $R_4$ each is selected from the group consisting of an alkyl group, an aryl group, an alkoxy group and an aryloxy group.

32. A silver halide photographic material comprising a support having thereon at least one silver halide emulsion layer and at least one pyrazoloazole type color image forming coupler having a releasing group represented by the general formula (I'), at a coupling active position:

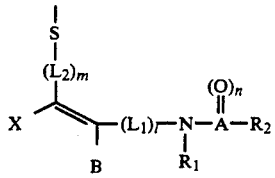

(I')

wherein $L_1$ and $L_2$ each represents a methylene group or an ethylene group; l and m each represents 0 or 1; $R_1$ represents a hydrogen atom, an alkyl group, an aryl group or a heterocyclic group;

wherein each $R_2$ group is substituted by a substituent selected from the group consisting of a halogen atom, an aliphatic group an aryl group, a heterocyclic group, an alkoxy group, an aryloxy group, an alkylamino group, an alkoxycarbonyl group, a carbamoyl group, an anilino group, a sulfamoyl group, an alkylsulfonyl group, an arylsulfonyl group, an alkylthio group, an arylthio group, an acyl group, an acylamino group, an imido group, a ureido group, a sulfamoylamino group, an alkoxycarbonylamino group, a sulfonamido group, a hydroxy group and a cyano group; A represents a carbon atom or a sulfur atom; n represents 1, when A is a carbon atom, or 1 or 2, when A is a sulfur atom; B represents a carbon atom, an oxygen atom, a nitrogen atom or a sulfur atom; X represents an atomic group necessary to form a ring; $R_1$ and $R_2$ may connect with each other to form a ring; and B and $R_2$ may connect with each other to form a ring, when B is a carbon atom or a nitrogen atom.

* * * * *